US009333131B2

(12) United States Patent
Griswold et al.

(10) Patent No.: US 9,333,131 B2
(45) Date of Patent: May 10, 2016

(54) PATIENT TRANSFER SYSTEM

(75) Inventors: Lee F Griswold, Bethel, CT (US); Edward A Gilchrest, Oxford, CT (US); Bruce Eidinger, Meriden, CT (US); David Beckstrom, Roxbury, CT (US)

(73) Assignee: Next Health, LLC, Rowayton, CT (US)

( * ) Notice: Subject to any disclaimer, the term of this patent is extended or adjusted under 35 U.S.C. 154(b) by 0 days.

(21) Appl. No.: 13/481,448

(22) Filed: May 25, 2012

(65) Prior Publication Data

US 2012/0297544 A1 Nov. 29, 2012

Related U.S. Application Data

(60) Provisional application No. 61/490,478, filed on May 26, 2011, provisional application No. 61/490,490, filed on May 26, 2011, provisional application No. 61/548,588, filed on Oct. 18, 2011, provisional application No. 61/592,886, filed on Jan. 31, 2012, provisional application No. 61/598,660, filed on Feb. 14, 2012.

(51) Int. Cl.
*A61G 1/003* (2006.01)
*A61G 5/10* (2006.01)
(Continued)

(52) U.S. Cl.
CPC *A61G 5/10* (2013.01); *A61G 5/107* (2013.01); *A61G 5/1067* (2013.01); *A61G 5/12* (2013.01);
(Continued)

(58) Field of Classification Search
CPC ..... A61G 5/10; A61G 5/1067; A61G 5/107; A61G 5/12; A61G 5/02; A61G 5/04; A61G 5/1075; A61G 5/006; A61G 5/14; A61G 7/002; A61G 7/015; A61G 7/018; A61G 7/05; A61G 7/1026; A61G 7/1036; A61G 7/1065; A61G 7/053; A61G 7/1044; A61G 7/16; A61G 2203/80; A61G 2203/42; A61G 2203/14; A61G 2005/1054; A61G 2005/127; A61G 2200/32; A61G 2200/34; A61G 2007/165; Y10T 29/49826
USPC ..... 5/81.1 R, 81.1 HS, 86.1, 83; 280/250.1
See application file for complete search history.

(56) References Cited

U.S. PATENT DOCUMENTS 1,635,575 A 7/1927 Cole
4,240,169 A 12/1980 Roos
(Continued)

FOREIGN PATENT DOCUMENTS

DE 102006011710 B3 8/2007
GB 2185883 A 8/1978

*Primary Examiner* — David E Sosnowski
*Assistant Examiner* — Morgan McClure
(74) *Attorney, Agent, or Firm* — Proskauer Rose LLP

(57) ABSTRACT

A system and method for patient transfer, including patient transfer from a bed to a rollable chair and patient transfer from a wheelchair to a bed. A docking assembly can connect a rollable chair to a bed for transfer. The systems and methods can provide a safe, dignified, and comfortable transfer for patients. A transfer bed, a docking assembly, and a wheelchair can be used together as a system and can reduce the physical and psychological burden of bedridden patients and their caregivers. The transfer bed, docking assembly, and wheelchair can be appropriate for use within a patient's home, nursing home, hospital or any location where a patient is transferred between a bed and a wheelchair. The transfer bed, docking assembly, and wheelchair can be controlled such that a patient is transferred from a bed to a wheelchair or from a wheelchair to a bed.

13 Claims, 21 Drawing Sheets

(51) Int. Cl.

| | |
|---|---|
| ***A61G 5/12*** | (2006.01) |
| ***A61G 7/002*** | (2006.01) |
| ***A61G 7/015*** | (2006.01) |
| ***A61G 7/018*** | (2006.01) |
| ***A61G 7/05*** | (2006.01) |
| *A61G 7/10* | (2006.01) |
| *A61G 5/00* | (2006.01) |
| *A61G 7/16* | (2006.01) |
| *A61G 5/02* | (2006.01) |
| *A61G 7/053* | (2006.01) |

(52) U.S. Cl.

CPC ..... *A61G 7/002* (2013.01); *A61G 7/015* (2013.01); *A61G 7/018* (2013.01); *A61G 7/05* (2013.01); *A61G 7/1026* (2013.01); *A61G 7/1036* (2013.01); *A61G 7/1065* (2013.01); *A61G 5/006* (2013.01); *A61G 5/02* (2013.01); *A61G 5/1075* (2013.01); *A61G 7/053* (2013.01); *A61G 7/1044* (2013.01); *A61G 7/16* (2013.01); *A61G 2005/1054* (2013.01); *A61G 2005/127* (2013.01); *A61G 2203/42* (2013.01); *A61G 2203/80* (2013.01); *Y10T 29/49826* (2015.01)

(56) References Cited

U.S. PATENT DOCUMENTS

| | | | |
|---|---|---|---|
| 4,654,903 | A | 4/1987 | Chubb et al. |
| 4,679,259 | A | 7/1987 | DiMatteo et al. |
| 4,700,415 | A | 10/1987 | DiMatteo et al. |
| 4,718,133 | A | 1/1988 | DiMatteo et al. |
| 4,726,082 | A | 2/1988 | DiMatteo et al. |
| 4,776,047 | A | 10/1988 | DiMatteo |
| 4,787,104 | A | 11/1988 | Grantham |
| 4,787,107 | A | 11/1988 | DiMatteo et al. |
| 4,796,313 | A | 1/1989 | DiMatteo et al. |
| 4,813,088 | A | 3/1989 | DiMatteo et al. |
| 4,819,283 | A | 4/1989 | DiMatteo et al. |
| 4,821,352 | A | 4/1989 | DiMatteo et al. |
| 4,837,872 | A | 6/1989 | DiMatteo et al. |
| 4,837,873 | A | 6/1989 | DiMatteo et al. |
| 4,941,220 | A | 7/1990 | DiMatteo et al. |
| 5,020,171 | A | 6/1991 | DiMatteo et al. |
| 5,050,899 | A | 9/1991 | Stensby |
| 5,103,512 | A | 4/1992 | DiMatteo et al. |
| 5,127,113 | A | 7/1992 | DiMatteo et al. |
| 5,319,813 | A | 6/1994 | DiMatteo et al. |
| 5,469,588 | A | 11/1995 | DiMatteo et al. |
| 5,526,543 | A | 6/1996 | DiMatteo |
| 5,535,459 | A | 7/1996 | DiMatteo et al. |
| 5,596,775 | A | 1/1997 | DiMatteo et al. |
| 5,634,688 | A | 6/1997 | Ellis |
| 6,846,042 | B2 | 1/2005 | Hanson et al. |
| 7,340,784 | B2 | 3/2008 | Stryker et al. |
| 7,568,240 | B2 | 8/2009 | Palay et al. |
| 7,712,165 | B2 | 5/2010 | Guguin |
| 7,735,165 | B2 | 6/2010 | Stryker et al. |
| 7,752,687 | B1 | 7/2010 | Denosky et al. |
| 7,841,611 | B2 | 11/2010 | Ivanchenko |
| 8,297,641 | B2 | 10/2012 | Landry et al. |
| 2011/0030138 | A1* | 2/2011 | Kawakami et al. ..... 5/2.1 |

* cited by examiner

PATIENT TRANSFER SYSTEM

CROSS-REFERENCE TO RELATED APPLICATIONS

This application claims the benefit of and priority to U.S. Provisional Patent Application No. 61/490,478, filed May 26, 2011, U.S. Provisional Patent Application No. 61/490,490, filed May 26, 2011, U.S. Provisional Patent Application No. 61/548,588, filed Oct. 18, 2011, and U.S. Provisional Patent Application No. 61/592,886, filed Jan. 31, 2012 and U.S. Provisional Patent Application No. 61/598,660, filed on Feb. 14, 2012, all of which are owned by the assignee of the instant application and the disclosures of which are herein incorporated by reference in their entireties.

FIELD OF THE TECHNOLOGY

The invention relates to devices, apparatuses, systems and methods for patient transfer, including patient transfer from a bed to a wheelchair and patient transfer from a wheelchair to a bed. The invention also relates to a docking assembly for docking various apparatus.

BACKGROUND

Transferring an invalid person between a bed and a wheelchair, standing position, commode, chair, walker, and/or a toilet can be a labor intensive and time consuming task. It can take multiple people and can cause injury to the invalid person and caregivers if errors are made during transfer. Systems exist that assist in transferring the patient. For example, transfer beds, transfer wheelchairs and Hoyer lifts.

Current systems typically require that a wheelchair having wheels smaller than a conventional wheelchair is used to transfer a patient from a wheelchair to a bed. This is undesirable because it can limit the mobility of the patient in the chair to a distance and terrain that a wheelchair with smaller wheels can travel about.

Current systems are typically limited in that when a wheelchair is positioned with respect to a bed for patient transfer, there is a gap between the seat of the wheelchair and the bed. In some systems, a patient can be caught in the gap, requiring manual assistance.

Current systems require that a wheelchair back rest be manually removed for a patient transfer between a wheelchair and a bed. This is undesirable because it requires manual intervention during the patient transfer.

SUMMARY OF THE INVENTION

Wheelchairs with wheels that are smaller than a conventional wheelchair size can make it difficult for a patient to travel further than a short distance in the wheelchair.

It is desirable for a patient transfer system that easily and quickly transfers a patient between a bed and a chair, commode, walker, standing and/or a toilet.

One advantage of the invention is that the invention can provide a safe, dignified, and comfortable transfer for patients. A transfer bed, a docking assembly, and a wheelchair can be used together as a system and can reduce the physical and psychological burden of bedridden patients and their caregivers. The transfer bed, docking assembly, and wheelchair can dramatically reduce the labor costs involved in patient transfer. By facilitating more frequent and less stressful movement, patients who may otherwise have to move to institutions can remain at home.

With minimal caregiver involvement in the transfer, the risk of fall-related patient injuries can be reduced substantially. Additionally, the invention can save time for the caregiver, reducing a process that occurs six to 10 times per day from over a long time (e.g., 30 minutes) to a shorter time (e.g., less than two minutes). The invention can allow for very little training to operate the system.

Another advantage of the invention is that the seat of the wheelchair can slide towards the bed. Another advantage of the invention is that the rear wheels of the wheelchair can be the size of a conventional wheelchair. Another advantage of the invention is minimization of the likelihood that the bed mattress shifts out of position during use, compelling a manual adjustment. For example, when the mattress moves from a horizontal position to a patient back support position, the mattress stays substantially along its intended path and typically will not slide off either side of the bed frame. Another advantage of the invention is that the upper portion of the bed frame and lower portion of the bed frame can be moved with one actuator, thus reducing the cost and maintenance of the bed. Another advantage of the invention is that the conveyor length does not have to substantially extend when the top frame portion and the bottom frame portion (e.g., the mattress) move from a horizontal position to a patient back support position. Another advantage of the invention is that the life of the conveyor is extended.

Another advantage of the invention is that the bed is modular. Another advantage of the invention is that it can be constructed of light weight materials.

Another advantage of the invention is that a wheelchair can have a back rest that slides into position so a patient can rest against it as a conventional wheelchair back rest, but can also be stored in the wheelchair, so as to not interfere with a patient transfer, and not require a difficult manual removal.

Another advantage of the invention is that a docking assembly can be constructed of lightweight materials (e.g., titanium, aluminum, steel, or carbon fiber). Another advantage of the invention is that the docking assembly can be removable.

It is understood by one skilled in the art that translate means to move in a linear direction. As used herein the term translating includes moving, sliding, actuating, shifting, gliding, and/or veering.

In one aspect of the invention, the apparatus can include a bed. The bed includes a bed frame having a head bed frame portion, a foot bed frame portion, and a stationary bed frame portion. The bed frame defines a first axis extending along a length of the bed frame. The bed can also include a mattress having a head mattress portion and a foot mattress portion. The head mattress portion is removably attached to the head bed frame portion. The foot mattress portion is removably attached to the foot bed frame portion. The bed can also include one or more actuators coupled to the bed frame. The one or more actuators pivot the head bed frame portion about a second axis that is perpendicular to the first axis. The one or more actuators pivot the foot bed frame portion about a third axis that is perpendicular to the first axis and disposed a distance from the second axis along the first axis.

In some embodiments, the actuator pivots the head bed frame portion and the foot bed frame portion with a substantially equal angular speed.

In some embodiments, the bed can also include a conveyor coupled to a first spool and a second spool. The first spool is coupled to the head bed frame portion. The second spool is coupled to the foot bed frame portion. The conveyor extends from the first spool over a top surface of the mattress to the second spool. The bed can also include a conveyor guide coupled the conveyor and the mattress. The conveyor guide positions the conveyor at a desired position on the mattress.

In some embodiments, the conveyor includes a detectable indicator that denotes a length the conveyor has to translate towards the first spool or the second spool. In some embodiments, the conveyor guide restricts movement of the conveyor to translation in a direction of the first axis extending along the length of the bed frame. In some embodiments, the conveyor guide can also include a splined interface coupled to a compression spring and a clamp. When the compression spring is in a first position the splined interface disengages from the clamp. When the compression spring is in a second position the splined interface engages with the clamp.

In some embodiments, the conveyor also includes a first mating portion coupled to a first end of the conveyor. The conveyor also includes the first mating portion coupled to the second end of the conveyor. The first spool also includes a second mating portion to receive the first mating portion coupled to the first end of the conveyor. The second spool also includes the second mating portion to receive the first mating portion coupled to the second end of the conveyor. In some embodiments, the first end of the conveyor also includes a first mark. The first spool includes a second mark. When the first mark and the second mark align during engagement of the first end of the conveyor and the first spool, the conveyor is centered with respect to the first spool. In some embodiments, the second end of the conveyor also includes a first mark. The second spool also includes a second mark. When the first mark and the second mark align during engagement of the second end of the conveyor and the second spool, the conveyor is centered with respect to the second spool.

In some embodiments, the bed also includes a headboard detachably attachable to the bed frame. In some embodiments, the bed also includes a headboard coupled to a head end of the bed frame. A sensor is coupled to the headboard to detect a head of a patient touching the headboard.

In some embodiments, the head bed frame portion is rotated to a first angle. The foot bed frame portion is rotated to a second angle. The head mattress portion and the foot mattress portion are substantially parallel to the first axis and substantially adjacent to the bed frame to allow a patient to lie horizontally in the bed. In some embodiments, the head bed frame portion is rotated to a first angle. The foot bed frame portion is rotated to a second angle. The head mattress portion is substantially parallel to the first axis and a first distance from the stationary bed frame portion. The foot mattress portion is adjacent the foot bed frame portion. The foot bed frame portion allows the foot mattress portion to support a patient in an upright position.

In some embodiments the first angle of the head bed frame portion is between 0 degrees to 65 degrees. The second angle of the foot bed frame portion is between 0 degrees to 65 degrees. In some embodiments, the first angle of the head bed frame portion is between 60 degrees to 65 degrees. The second angle of the foot bed frame portion is between 60 degrees to 65 degrees. In some embodiments, the head bed frame portion is removably attachable to the bed frame, the foot bed frame portion is removable attachable to the bed frame, the stationary bed frame portion is removably attachable to the bed frame, or any combination thereof. In some embodiments the bed frame receives an assembly to assist in transferring a patient from a rollable chair to the bed.

In some embodiments the conveyor also includes a sheet coupled to the conveyor by a zipper. In some embodiments, the sheet includes a slot to allow for an incontinence pad.

In some embodiments, the actuator rotates the head bed frame portion and the foot bed frame portion between 10 degrees per second and 12 degrees per second. In some embodiments, the bed frame is formed of at lest one of titanium, aluminum, steel, or carbon fiber. In some embodiments the bed frame also includes a first bed frame portion. The first bed frame portion includes the head bed frame portion and the foot bed frame portion. The bed frame also includes a second bed frame portion. The second bed frame portion includes the stationary bed frame, such that the first bed frame portion is detachably attachable to the second bed frame portion.

In another aspect, a method for moving a bed involves attaching a head mattress portion of a mattress to a head bed frame portion of the bed. The bed defines a first axis that extends along a length of the bed. The method also involves attaching a foot mattress portion of the mattress to a foot bed frame portion of the bed. The method also involves pivoting the head bed frame portion of the bed about a second axis that is perpendicular to the first axis. The method also involves pivoting the foot bed frame portion of the bed about a third axis that is perpendicular to the first axis and disposed a distance from the second axis along the first axis.

In some embodiments, the method also involves coupling a first spool to the head bed frame portion. The method also involves a second spool to the foot bed frame portion. The method also involves extending a conveyor over a top of the mattress from the first spool to the second spool. In some embodiments, the method also involves positioning the conveyor over the mattress to a desired position using a conveyor guide. The conveyor guide is coupled to the conveyor and the mattress. The method also involves measuring a position of the conveyor using one or more sensors to detect the position of the conveyor to the first and second spool.

In some embodiments, the method also involves one or more actuators pivoting the head bed frame portion and the foot bed frame portion with a substantially equal angular speed. In some embodiments, the method also involves determining a length the conveyor has to translate towards the first spool or the second spool based on a detectable indicator. The detectable indicator is coupled to the conveyor.

In some embodiments, the method also involves rotating the head bed frame portion to a first angle. The method also involves rotating the foot bed frame portion to a second angle. The head mattress portion and the foot mattress portion are substantially parallel to the first axis and substantially adjacent to the bed frame to allow a patient to lie horizontally in the bed.

In some embodiments, the method also involves rotating the head bed frame portion to a first angle. The method also involves rotating the foot bed frame portion to a second angle. The head mattress portion is substantially parallel to the first axis and a first distance from a stationary bed frame portion of the bed. The foot mattress portion is adjacent the foot bed frame portion to allow the foot mattress portion to support a patient in an upright position.

In some embodiments, the method also involves a stationary bed frame portion of the bed to receive an assembly to assist in transferring a patient from a rollable chair to the bed. In some embodiments, the method also involves coupling a sheet to the conveyor by a zipper. In some embodiments, the method also involves a slot in the sheet to allow for an incontinence pad.

In some embodiments, the method also involves pivoting the head bed frame portion and the foot bed frame portion between 10 degrees per second and 12 degrees per second. In some embodiments, the method also involves pivoting the first angle between 0 degrees to 65 degrees. The method also involves pivoting the second angle between 0 degrees and 65 degrees. In some embodiments, the method also involves pivoting the first angle between 60 degrees and 65 degrees. The method also involves pivoting the second angle between 60 degrees and 65 degrees.

In another aspect, the invention includes a docking assembly. The docking assembly includes a first frame attachable to a chair. After attachment, the first frame stabilizes the chair to keep the chair substantially stationary when a patient is transferred into and out of the chair. The docking assembly also includes a second frame. The second frame is mounted on the first frame. The second frame is capable of translating relative to the first frame along a first axis. The second frame is attachable to the chair and causing the seat of the chair to translate. The docking assembly also includes a third frame. The third frame is mounted on the second frame. The third frame is capable of translating relative to the second frame along the first axis. The third frame is attachable to the chair and causing the seat of the chair to rotate.

In some embodiments, the first frame of the docking assembly detachably attaches to first frame of the chair. In some embodiments the second frame of the docking assembly mounts to the first frame by one or more sliding assemblies. In some embodiments, the third frame mounts to the second frame by one or more sliding assemblies. In some embodiments, the docking assembly also includes a first latch. The first latch is coupled to the first frame to detachably attach the first frame to the chair. The docking assembly also includes a second latch. The second latch is coupled to the second frame to detachably attach the second frame to the chair. The docking assembly also includes a third latch. The third latch is coupled to the third frame to detachably attach the third frame to the chair.

In some embodiments, the docking assembly also includes one or more actuators. The one or more actuators translate the second frame a first desired distance and a first desired direction relative to the first frame, translate the third frame a second desired distance and a second desired direction relative to the second frame, or any combination thereof.

In some embodiments, the docking assembly also includes a housing that surrounds the first frame, the second frame and the third frame. In some embodiments, the docking assembly also detachably attaches to an apparatus to be stabilized. In some embodiments, the docking assembly also detachably attaches to a wheelchair or a walker. In some embodiments, the docking assembly also detachably attaches to a bed.

In another aspect, the invention involves a method for attaching a chair to a docking assembly. The method involves attaching a chair to a first frame. After attachment, the first frame stabilizes the chair to keep the chair substantially stationary when a patient is transferred into and out of the chair. The method involves attaching the chair to a second frame. The second frame is mounted on the first frame. The second frame is capable of translating relative to the first frame along a first axis, the second frame attachable to the chair and causing the seat of the chair to translate. The method involves attaching the chair to a third frame of the docking assembly. The third frame is mounted on the second frame. The third frame is capable of translating relative to the second frame along the first axis, the third frame attachable to the chair and causing the seat of the chair to rotate.

In some embodiments, the method also involves coupling a first latch to the first frame to detachably attach the first frame to the chair. In some embodiments, the method also involves coupling a second latch to the second frame to detachably attach the second frame to the chair. The method also involves coupling a third latch to the third frame to detachably attach the third frame to the chair.

In some embodiments, the method also involves configuring one or more actuators. The one or more actuators translate the second frame a first desired distance and a first desired direction relative to the first frame, translate the third frame a second desired distance and a second desired direction relative to the second frame, or any combination thereof.

In some embodiments, the method also involves attaching the docking assembly to a bed. In some embodiments, the method also involves a chair as a wheelchair.

In another aspect, the invention includes a rollable chair. The rollable chair includes a first frame. The first frame allows the rollable chair to remain substantially stationary when attached to a docking mechanism. The rollable chair includes a second frame coupled to the first frame. The second frame allows a seat of the rollable chair to translate relative the first frame along a first axis, the first axis extending along a length of the rollable chair. The rollable chair includes a third frame coupled to the second frame. The third frame allows the seat of the rollable chair to rotate about a second axis that is perpendicular to the first axis and to attach to the docking mechanism.

In some embodiments, the rollable chair also includes a chair back having a top end and a bottom end. In some embodiments, the rollable chair also includes a push handle coupled to the top end of the chair back. In some embodiments, the rollable chair also includes a chair back guide coupled to the rollable chair. The chair back translates along the chair back guide. The chair back translates such that in a first position a top end of the chair back extends a vertical distance above the seat of the rollable chair. The chair back translates such that in a second position, the top end of the chair back is vertically even with the seat of the rollable chair.

In some embodiments, the rollable chair also includes a push handle. The push handle includes a locking mechanism to prevent the push handle from rotating when in a locked position and to allow the push handle to rotate when in an unlocked position. In some embodiments, the locking mechanism of the rollable chair also includes a first pin on the first frame. The locking mechanism of the rollable chair includes a second pin on the chair back. The first pin engages the second pin to unlock or lock the push handle based on whether the first frame is positioned for patient transfer.

In some embodiments, the rollable chair also includes a locking mechanism to prevent the third frame from translating when the chair is not attached to the docking mechanism. In some embodiments, the rollable chair also includes an interlock system. The interlock system is coupled to the rollable chair. The interlock system allows the seat to translate and rotate when in an unlocked position. The interlock system prevents the seat from translating and rotating when in a locked position.

In some embodiments, the interlock system allows the chair back to translate when in an unlocked position and prevents the chair back from translating when in a locked position. In some embodiments, the interlock system also includes a cam that is actuated into a locked position or an unlocked position by a pin and spring. In some embodiments, the cam is actuated into an unlocked position when the seat frame translates a desired distance. In some embodiments, the seat rotates to a desired angle. In some embodiments, the desired angle is based on a weight of a patient, a height of the patient, a speed of a conveyor that is attached to a bed the patient is transferred to moves, or any combination thereof. In some embodiments, the desired angle is between 105 degrees and 120 degrees.

In some embodiments, the seat translates to a desired distance. In some embodiments, the desired distance is based on a weight of a patient, a height of the patient, a distance between a bed the patient is transferred to and the seat of the rollable chair, or any combination thereof. In some embodiments, the desired distance is between 0 inches and 9.0 inches.

In some embodiments, the rollable chair also includes a bi-directional linear pulley mechanism coupled to the second frame and the third frame. The bi-directional linear pulley mechanism allows the seat of the rollable chair to translate to a desired position and rotate to a desired angle. In some embodiments, bi-directional linear pulley mechanism also includes one or more idler pulleys. The bi-directional linear pulley mechanism also includes a cable threaded around the one or more idler pulleys. The bi-directional linear pulley mechanism also includes a driven pulley. The driven pulley is attached to the cable and coupled to the second frame and third frame of the rollable chair. When the driven pulley is rotated in a first direction, the seat translates to a first desired position and rotates to a first desired angle. When the driven pulley is rotated in a second direction, the seat translates to a second desired position and rotates to a second desired angle.

In some embodiments, the rollable chair is a wheelchair. In some embodiments, the rollable chair also includes a leg ramp. In some embodiments, the leg ramp also includes one or more sensors to detect whether a patient is being transferred from the bed to the rollable chair.

In another aspect, the invention involves a method for arranging a rollable chair. The method involves coupling a first frame to a second frame. The first frame causes the rollable chair to remain substantially stationary when attached to a docking mechanism. The second frame allows a seat of the rollable chair to translate relative the first frame along a first axis. The method involves coupling a third frame to the second frame. The third frame allows the seat of the rollable chair to rotate about a second axis perpendicular to the first axis and to attach to the docking mechanism.

In some embodiments, the method also involves rotating the seat to a desired angle. In some embodiments, the desired angle is based on a speed a conveyor that is attached to a bed the patient is transferred to moves. In some embodiments, the desired angle is between 105 degrees and 120 degrees. In some embodiments, the method also involves translating the seat to a desired distance. In some embodiments, the desired distance is based on a distance between a bed the patient is transferred to and the seat of the rollable chair. In some embodiments, wherein the desired distance is between 0 inches and 9.0 inches.

In another aspect, the invention involves a method for positioning a chair back of a rollable chair. The method involves providing a rollable chair having a chair back. The method involves translating the chair back between a first position and a second position. In the first position, a top end of the chair back extends a vertical distance above the seat of the rollable chair. In the second position, the top end of the chair back is vertically even with the seat of the rollable chair.

In some embodiments, the chair back translates along a chair back guide. In some embodiments, the method also involves locking the chair back to prevent the chair back from translating. The method also involves unlocking the chair back to allow the chair back to translate from the first position to the second position. In some embodiments, the method also involves locking a push handle coupled to the chair back to prevent the push handle from rotating. The method also involves unlocking the push handle to allow the push handle to rotate. In some embodiments, the method also involves preventing the third frame from translating when the chair is not attached to the docking mechanism.

In another aspect, the invention includes a patient transfer assembly. The patient transfer assembly includes a bed. The bed includes a bed frame having a head bed frame portion, a foot bed frame portion, and a stationary bed frame portion, the bed frame defining a first axis extending along a length of the bed frame. The bed also includes a mattress having a head mattress portion and a foot mattress portion, the head mattress portion removably attached to the head bed frame portion and the foot mattress portion removably attached to the foot bed frame portion. The bed also includes one or more actuators coupled to the bed frame. The one or more actuators pivoting the head bed frame portion about a second axis that is perpendicular to the first axis and the foot bed frame portion about a third axis that is perpendicular to the first axis such that angular speed of the head bed frame portion and the foot bed frame portion is at least substantially equal. The patient transfer assembly also includes a docking assembly. The docking assembly is detachably attachable to the bed. The docking assembly includes a first docking assembly frame attachable to the rollable chair. After attachment, the docking assembly stabilizes the rollable chair to keep the rollable chair substantially stationary when a patient is transferred into and out of the rollable chair. The docking assembly also includes a second docking assembly frame mounted on the first docking assembly frame and capable of translating relative to the first frame along a third axis, the second docking assembly frame attachable to the chair and causing the seat of the rollable chair to translate. The docking assembly also includes a third docking assembly frame mounted on the second docking assembly frame and capable of translating relative to the second docking assembly frame along the third axis, the third docking assembly frame attachable to the rollable chair and causing the seat of the rollable chair to rotate. The patient transfer assembly also includes a rollable chair. The rollable chair is detachably attachable to the docking assembly. The rollable chair includes a first rollable chair frame allows the rollable chair to remain substantially stationary when attached to the docking assembly. The rollable chair also includes a second rollable chair frame coupled to the first rollable chair frame, the second rollable chair frame allows a seat of the rollable chair to translate relative to the first rollable chair frame along a fourth axis, the fourth axis extending along length of the rollable chair. The rollable chair also includes a third rollable chair frame coupled to the second rollable chair frame, the third rollable chair frame allows the seat of the rollable chair to rotate about a fifth axis that is perpendicular to the fourth axis and to attach to the docking mechanism.

In another aspect, the invention involves a method of transferring a patient between a bed and a rollable chair. The method involves rolling a back end of the rollable chair towards a foot end of a bed causing a first frame of the rollable chair to securely attach onto a first frame of a docking assembly. The method involves translating a seat of the rollable chair towards the foot end of the bed. The method involves transferring a patient on the seat of the rollable chair from the rollable chair to the bed.

In some embodiments, the docking assembly comprises a second frame, a third frame, and the first frame. The method also involves translating the second frame of the docking assembly and the third frame of the docking assembly a first distance towards the rollable chair, such that a second frame of the rollable chair latches onto the second frame of the docking assembly, and a third frame of the rollable chair latches onto the third frame of the docking assembly. The method also involves translating the second frame of the docking assembly and the third frame of the rollable chair a second distance towards a head end of the bed at a substantially equal rate such that a seat of the rollable chair translates towards the foot end of the bed. The method also involves translating the third frame of the docking assembly a third distance towards a head end of the bed such that the seat of the rollable chair rotates to a desired angle.

In some embodiments, the method also involves translating a back rest of the rollable chair into a stored position within the rollable chair.

In another aspect, the invention involves a method of transferring a patient between a bed and a rollable chair. The method involves sensing that the patient is positioned on a leg ramp of the rollable chair. The method involves rotating a seat of the rollable chair to receive a patient when the leg ramp senses the patient. The method involves translating the seat of the rollable chair away from a foot end of the bed along an axis extending along a length of the bed. The method involves transferring a patient in the bed from the bed to the rollable chair.

In some embodiments, the seat of the rollable chair rotates at a first speed and a conveyor coupled to the bed translates at a second speed, the first speed and the second speed are such that a first portion of the patient touching the rollable chair moves at substantially the same speed as a second portion of the patient touching the conveyor. In some embodiments, a docking assembly includes a third frame, a second frame, and a first frame, and the method also involves translating the third frame of the docking assembly a first distance away from the foot end of the bed such that the seat of the rollable chair rotates. The method also involves translating the third frame of the docking assembly and the second frame of the docking assembly a second distance away from the foot end of the bed such that the seat of the rollable chair rotates. In some embodiments, the method also involves translating a back rest of the rollable chair from a stored position into a patient back support position.

In another aspect, the invention involves a method transferring a patient between a bed and a rollable chair. The method involves attaching a head mattress portion of a mattress to a head bed frame portion of the bed, the bed defining a first axis that extends along a length of the bed. The method involves attaching a foot mattress portion of the mattress to a foot bed frame portion of the bed. The method involves pivoting the head frame portion of the bed about a second axis that is perpendicular to the first axis at an angular speed. The method involves pivoting the foot bed frame portion of the bed about a third axis that is perpendicular to the first axis and disposed a set distance from the second axis along the first axis at substantially the angular speed. The method involves rolling a rear of a rollable chair towards the foot bed frame portion of the bed causing a chassis of the rollable chair to latch onto a stationary frame of a docking assembly that is coupled to the bed, the docking assembly having a seat rotation frame, a seat slide frame, and the stationary frame. The method involves translating a back rest of the rollable chair into a stored position within the rollable chair. The method involves translating the seat slide frame of the docking assembly and the seat rotation frame of the docking assembly a first distance towards the rollable chair such that a) a seat frame on the rollable chair latches onto the seat slide frame of the docking assembly, and b) a rotation frame on the rollable chair latches onto the seat rotation frame of the docking assembly. The method involves translating the seat slide frame of the docking assembly and the seat rotation frame of the rollable chair a second distance towards the head end of the bed at a substantially equal rate such that a seat of the rollable chair translates towards the foot end of the bed. The method involves translating the seat rotation frame of the docking assembly a third distance towards the head end of the bed such that the seat of the rollable chair rotates.

In another aspect, the invention involves a method for moving a bed. The method involves attaching a head mattress portion of a mattress to a head bed frame portion of the bed, the bed defining a first axis that extends along a length of the bed. The method involves attaching a foot mattress portion of the mattress to a foot bed frame portion of the bed. The method involves pivoting the head frame portion of the bed about a second axis that is perpendicular to the first axis at an angular speed. The method involves pivoting the foot bed frame portion of the bed about a third axis that is perpendicular to the first axis and disposed a set distance from the second axis along the first axis at substantially the angular speed. The method involves sensing that the patient has been positioned onto a seat of the rollable chair, the rollable chair docked in a docking assembly coupled to the bed, the docking assembly having a seat rotation frame, a seat slide frame and a stationary frame. The method involves translating a seat rotation frame of the docking assembly a first distance towards the rollable chair such that the seat of the rollable chair rotates. The method involves translating the seat rotation frame of the docking assembly and the seat slide frame of the docking assembly a second distance towards the rollable chair such that the seat of the rollable chair translates. The method involves translating a back rest of the rollable chair from a stored position into a patient back support position.

In another aspect, the invention includes a controller for controlling a patient transfer assembly to transfer a patient between a bed and a rollable chair. The controller includes a bed control module. The bed control module outputs a) a first angle to command rotation of a head bed frame portion of a bed frame of the bed, and b) a second angle to command rotation of a foot bed frame portion of the bed frame of the bed, the first angle and the second angle are based on whether a patient is transferring from the rollable chair to the bed or from the bed to the rollable chair. The controller includes a docking assembly module that outputs a) a seat slide frame distance and a seat slide frame direction to command a seat slide frame of the docking assembly to translate based on whether a patient is transferring from the rollable chair to the bed or from the bed to the rollable chair, and b) a seat rotation frame angle to command a seat of the rollable chair to rotate to an angle based on whether a patient is transferring from the rollable chair to the bed or from the bed to the rollable chair. The controller includes a conveyor module that outputs a conveyor position to command a conveyor detachably attached to the head bed frame portion and the foot bed frame portion to translate based on whether a patient is transferring from the rollable chair to the bed or from the bed to the rollable chair.

In some embodiments, a) the first angle positions the head bed frame portion such that a head mattress portion of a mattress that is detachably attached to the head bed frame portion is substantially parallel to a first axis and a first distance from a stationary bed frame portion of the bed frame of the bed, the first axis extends along a length of the bed frame, and b) the second angle positions the foot bed frame portion such that a foot mattress portion of the mattress that is detachably attached to the foot bed frame portion is adjacent the foot bed frame portion to allow the foot mattress portion to support the patient's back in an upright position.

In some embodiments, a) the first angle positions the head bed frame portion such that a head mattress portion of a mattress that is detachably attached to the head bed frame portion is substantially parallel to a first axis and substantially adjacent to the bed frame, the first axis extends along a length of the bed frame, and b) the second angle positions the foot bed frame portion such that a foot mattress portion of the mattress that is detachably attached to the foot bed frame portion is substantially parallel to a first axis and substantially adjacent to the bed frame to allow a patient to lie horizontally in the bed.

In some embodiments, the seat slide direction comprises a first seat slide direction and a second seat slide direction, such that when a patient is transferred from the rollable chair to the bed, the first seat slide direction is towards the rollable chair and the second seat slide direction is towards the bed. In some embodiments, the seat slide direction comprises a first seat slide direction and a second seat slide direction, such that when a patient is transferred from the bed to the rollable chair, the first seat slide direction is towards the bed and the second seat slide direction is towards the rollable chair. In some embodiments, the seat rotation frame angle is towards the bed when a patient is transferred between the rollable chair and the bed.

BRIEF DESCRIPTION OF THE DRAWINGS

The advantages of the invention described above, together with further advantages, may be better understood by referring to the following description taken in conjunction with the accompanying drawings. The drawings are not necessarily to scale, emphasis instead generally being placed upon illustrating the principles of the invention.

DETAILED DESCRIPTION OF THE DRAWINGS

Reference will now be made in detail to embodiments of the invention, one or more examples of which are illustrated in the figures. Each embodiment described or illustrated herein is presented for purposes of explanation of the invention, and not as a limitation of the invention. For example, features illustrated or described as part of one embodiment can be used with another embodiment to yield still a further embodiment. It is intended that the present invention include these and other modifications and variations as further embodiments.

It is understood by one skilled in the art that translate means to move in a linear direction. As used herein the term translating includes moving, sliding, actuating, shifting, gliding, and/or veering.

Figure 1:
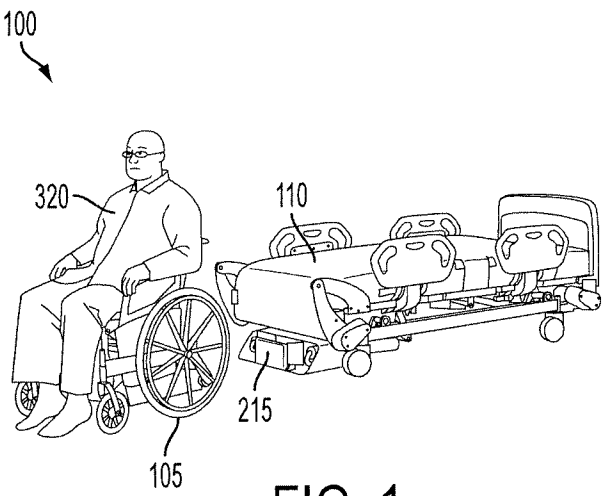
FIGS. 1-5B are diagrams of a transfer bed, a wheelchair, and a docking assembly in various configurations and stages of operation, according to illustrative embodiments of the invention.

FIGS. 1-5B are diagrams of a transfer bed, a wheelchair, and a docking assembly in various configurations and stages of operation, according to illustrative embodiments of the invention. FIG. 1 is a diagram 100 showing a transfer bed 110 and a wheelchair 105 in an undocked position. A docking assembly 215 is attached to the transfer bed 110. A top bed frame portion (e.g., a head bed frame portion) of the transfer bed and a bottom bed frame portion (e.g., a foot bed frame portion) of the transfer bed are in a horizontal position. A seat of the wheelchair is in a wheelchair ride position (e.g., patient 320 can sit on the seat to ride in the wheelchair).

Figure 2:
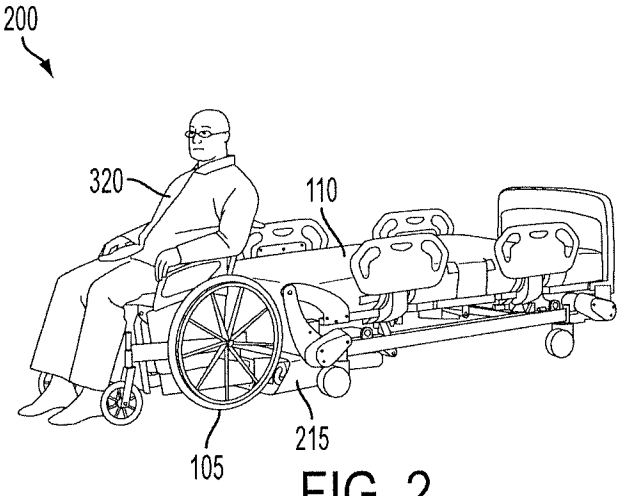

FIG. 2 is a diagram 200 of the wheelchair 105 docked to the transfer bed 110 via a docking assembly 215. A head bed frame portion of the transfer bed and a foot bed frame portion of the transfer bed can be in a horizontal position. A mattress is horizontal with respect to the floor. The seat of the wheelchair is still in a wheelchair ride position.

Figure 3:
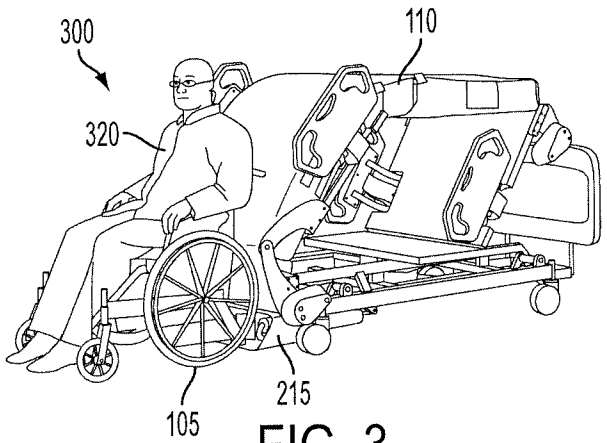

FIG. 3 is a diagram 300 of the head bed frame portion of the transfer bed rotated to a patient back support position, and the foot bed frame portion of the transfer bed rotated to a patient back support position, such that a patient 320 can use the foot mattress portion of the mattress as a back support. The seat of the wheelchair in a patient transfer position (e.g., slid and rotated towards the bed).

Figure 4:
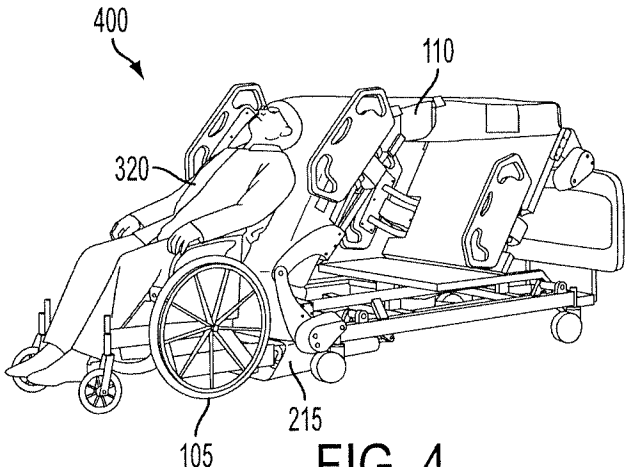

FIG. 4 is a diagram 400 of the wheelchair is in a patient transfer position (e.g., slid and rotated towards the bed). The chair back of the wheelchair can be in a stored position (e.g., as described in detail below in FIGS. 11-12). The head bed frame portion and the foot bed frame portion are in the same positions as described in FIG. 3.

Figure 5A:
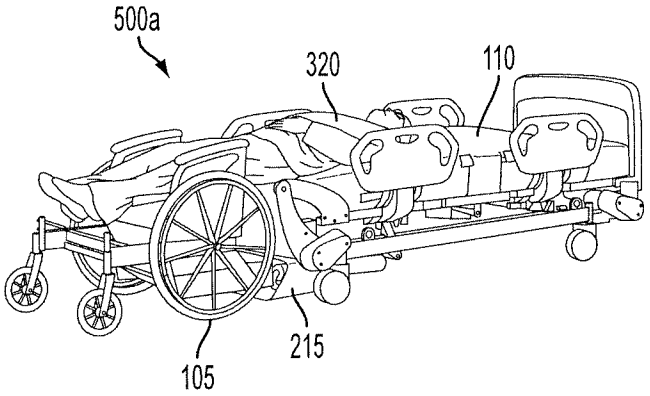
Figure 5:
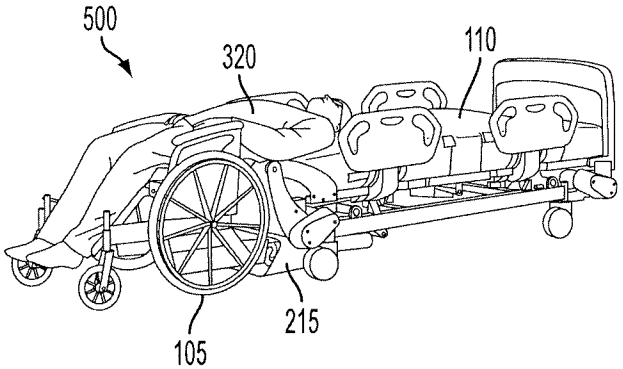

FIG. 5 is a diagram 500 showing the head bed frame portion of the transfer bed and the foot bed frame portion of the transfer bed rotate back to the horizontal position, lying the patient 320 down onto the bed. The wheelchair 105 is still docked to the docking assembly 215.

FIG. 5A is a diagram 500*a* showing the patient 320 being transferred into the transfer bed 110. The head bed frame portion of the transfer bed and the foot bed frame portion of the transfer bed are still horizontal, and a conveyor of the bed begins to translate such that the patient 320 is moved onto the bed. As a conveyor transfers the patient 320 towards the head end of the bed, the wheelchair seat can rotate towards the bed.

Figure 5B:
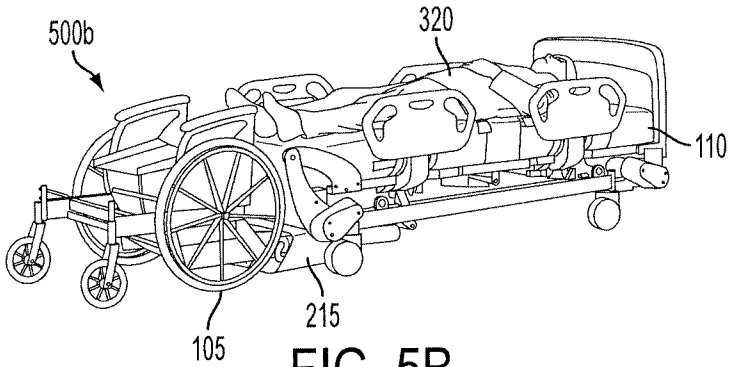

FIG. 5B is a diagram 500*b* showing the completed patient transfer from the wheelchair 105 to the transfer bed 110. The head bed frame portion of the transfer bed and the foot bed frame portion of the transfer bed are still horizontal. The conveyor can complete the transfer by translating the patient 320 until the patient's head reaches a predetermined position towards the head of the bed.

Figure 6:
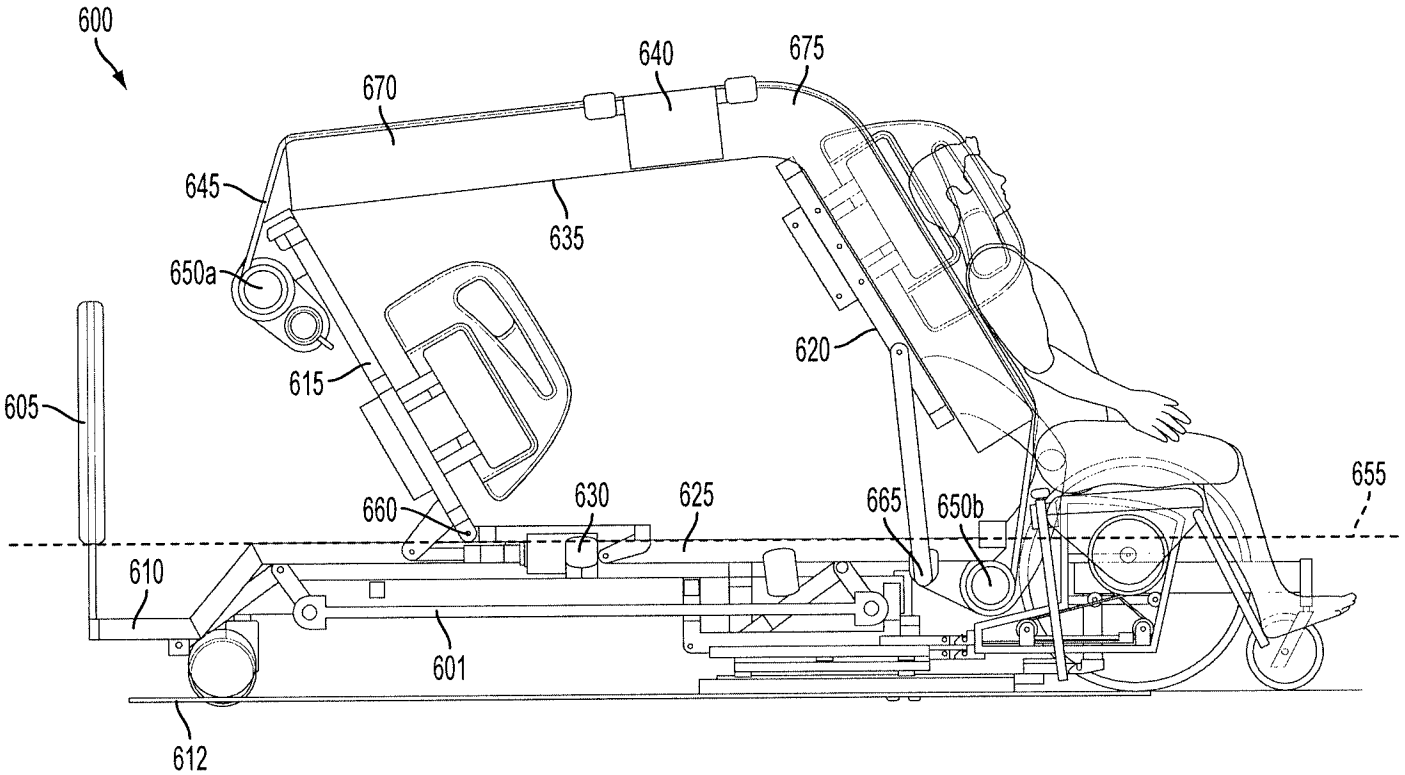
FIG. 6 is a diagram showing a transfer bed, according to an illustrative embodiment of the invention.

FIG. 6 is a diagram 600 showing a transfer bed, according to an illustrative embodiment of the invention. The transfer bed 601, includes a headboard 605, a bed frame 610, a head bed frame portion 615 (e.g., head deck), a foot bed frame portion 620 (e.g., foot deck or transfer deck), a stationary bed frame portion 625 (e.g., a seat deck), linear actuator 630, a mattress 635, a conveyor guide 640, a conveyor 645, two conveyor spools 650*a*, 650*b*, and other elements as shown in FIG. 6. The head bed frame portion 615, the foot bed frame portion 620, and the linear actuator 630 move the mattress 635 between a horizontal position and an upright position (e.g., the upright position as shown in FIG. 6).

The bed frame 610, the head bed frame portion 615, the foot bed frame portion 620, and the stationary bed frame portion 625 and the mattress 635 can be removably attachable to each other, such that when transporting the transfer bed 601, each piece can be carried separately rather than move the transfer bed 601 as one large item. In some embodiments, the bed frame 610, the head bed frame portion 615, the foot bed frame portion 620, and the stationary bed frame portion 625 are removably attachable to each other by quick release pins. In some embodiments, the bed frame 610, the head bed frame portion 615, the foot bed frame portion 620, and the stationary bed frame portion 625 connect and disconnect for moving, assembling, and/or installing the bed by any means known to those in the art. The bed frame 610 can be formed of at least one of titanium, aluminum, steel, or carbon fiber.

In some embodiments, the headboard 605 is detachably attachable to the bed frame 610. The headboard 605 can be coupled to a head end of the bed frame. A sensor (not shown) can be coupled to the headboard 605 to detect a head of a patient touching the headboard 605. The sensor can be a pressure sensor, a position sensor, and/or any sensor known in the art. In some embodiments, the bed frame 610 receives an assembly to assist in transferring a patient between a chair and the transfer bed 601.

Figure 6A:
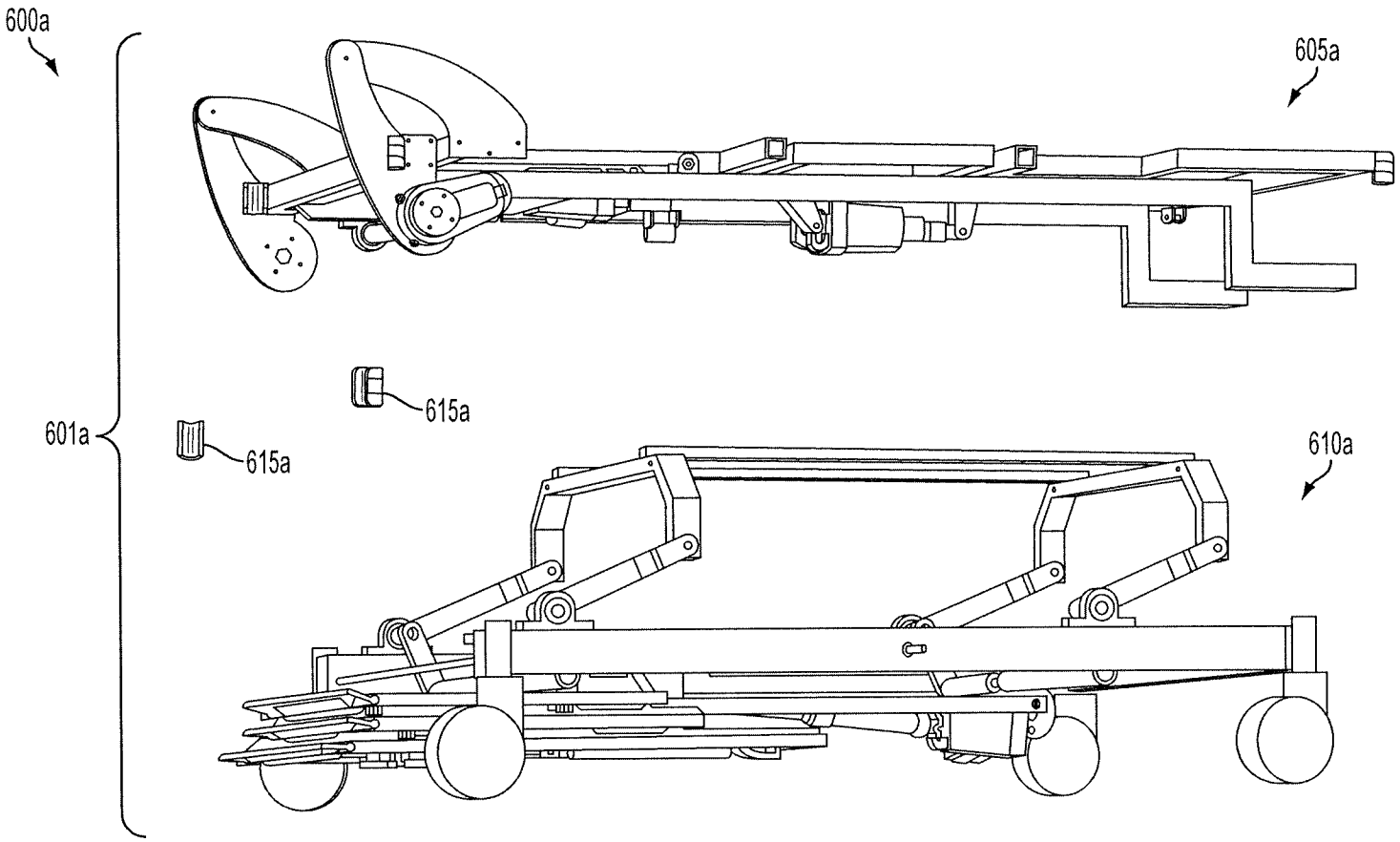
FIG. 6A is an exemplary diagram showing portions of a bed frame in a disassembled configuration, according to an illustrative embodiment of the invention.

FIG. 6A is an exemplary diagram 600*a* showing portions of a bed frame (e.g., a bed frame 610 as described above in FIG. 6) in a disassembled configuration, according to an illustrative embodiment of the invention. A bed frame 601*a* can have a first bed frame portion 605*a* and a second bed frame portion 610*a*. The first bed frame portion 605*a* can include a head bed frame portion and a foot bed frame portion (e.g., head bed frame portion 615 and foot bed frame portion 620 as shown above in FIG. 6). The second bed frame portion 610*a* can include a stationary bed frame (e.g., stationary bed frame portion 625 as shown above in FIG. 6). The second bed frame portion 610*a* can be detachably attachable to the first bed frame portion 605*a*.

The first bed frame portion 605*a* and the second bed frame portion 610*a* can be connected or disconnected using one or more quick release pins 615*a*. The bed frame 601*a* can be formed of metal or composites. Separating the bed frame 601*a* into the first bed frame portion 605*a* and the second bed frame portion 610*a* can allow the bed to be easily moved and installed for use.

Returning to FIG. 6, the bed frame 610 can define a first axis 655 that is along the length of the transfer bed 601. A second axis 660 can be defined as an axis substantially perpendicular to the first axis (e.g., the second axis can be along an axis extending out of the page). A third axis 665 can be defined as an axis substantially perpendicular to the first axis and disposed a distance from the second axis 660 along the first axis 655 (e.g., the third axis can be along an axis extending out of the page).

When the head bed frame portion 615 and the foot bed frame portion 620 are in a horizontal position (not shown), a top portion of the mattress 670 (e.g., head mattress portion) and a bottom portion of the mattress 675 (e.g., foot mattress portion) are each positioned substantially horizontal with respect to a floor 612 and substantially parallel to the first axis 655, such that the patient can lie horizontally on the mattress, as shown, for example, in FIG. 5B. When the head bed frame portion 615 and the foot bed frame portion 620 rotate about the second axis 660 and third axis 665 into a patient transfer position (e.g., partially vertical), the top portion of the mattress 670 is substantially horizontal with respect to the floor 612 and raised a distance above the stationary frame 625 and the bottom portion of the mattress 675 is partially vertical with respect to the floor 612. The patient can use the bottom portion of the mattress 675 as a back rest when, for example, the patient is seated in a wheelchair. In some embodiments, the bed frame 610 is raised or lowered to a desired position parallel to the first axis 655.

The linear actuator 630 is coupled to the transfer bed 601 and pivots the head bed frame portion 615 about the second axis 660 and the foot bed frame portion 620 about the third axis 665. The linear actuator 630 can be used to rotate the head bed frame portion 615 and the foot bed frame portion 620 between the horizontal position (e.g., as shown above in FIG. 1) and upright position (e.g., as shown above in FIG. 4) around the second axis 660 and the third axis 665. The linear actuator 630 can rotate the head bed frame portion 615 to a first desired angle. The linear actuator 630 can rotate the foot bed frame portion 620 to a second desired angle. The first desired angle and the second desired angle can be substantially equal, such that the head bed frame portion 615 and the foot bed frame portion 620 are rotated to substantially the same angle. In some embodiments, the head bed frame portion 615 and the foot bed frame portion 620 are rotated by multiple linear actuators.

The head bed frame portion 615 can be rotated to a first angle, and the foot bed frame portion 620 can be rotated to a second angle, such that the head mattress portion 670 and the foot mattress portion 675 are substantially parallel to the first axis 655 and substantially adjacent to the bed frame 610, so that a patient may lie horizontally in the bed. In some embodiments, the head bed frame portion 615 is rotated to a first angle, positioning the head mattress portion 670 substantially parallel to the first axis 655 and a distance from the bed frame 610. The foot bed portion 620 can be rotated to a second angle, positioning the foot mattress portion 675 adjacent to the foot bed frame portion 620 to support a patient in an upright position. The foot mattress portion 675 of the mattress 635 can be used as a back rest when, for example, the patient is seated in the wheelchair.

In some embodiments, the head bed frame portion 615 is rotated to an angle between 0 degrees and 65 degrees. In some embodiments, the foot bed frame portion 620 is rotated to an angle between 0 degrees and 65 degrees. In some embodiments, the head bed frame portion 615 and the foot bed frame portion 620 is rotated to substantially the same angle. When the head bed frame portion 615 and the foot bed frame portion 620 are at an angle between 60 degrees and 65 degrees, the head mattress portion 670 and the foot mattress portion 675 are positioned to allow a patient to use the foot mattress portion 675 as a back rest in an upright position.

In various configurations, the head bed frame portion 615 can be rotated to a first desired angle while the foot bed frame portion 620 remains un-rotated (e.g., horizontal), in which case the patient's head can be elevated with respect to the patient's feet. Likewise, the foot bed frame portion 620 can be rotated to a second desired angle while the head bed frame portion 615 remains un-rotated (e.g., horizontal), in which case the patient's feet can be elevated with respect to the patient's head.

The first desired angle and the second desired angle can be set, based on a maximum and/or a minimum height the mattress 635 can elevate off of the bed, based on a patient's tilt with respect to the wheelchair seat, or any combination thereof. The linear actuator 630 can be controlled by a controller and/or the patient/caregiver.

The linear actuator 630 can rotate the head bed frame portion 615 and the foot bed frame portion 620 with a desired angular speed. The desired angular speed can be substantially equal for each of the head bed frame portion 615 and the foot bed frame portion 620. For example, the head bed frame portion 615 and the foot bed frame portion 620 can rotate at an angular speed of 10 degrees per second to 12 degrees per second. The angular speed can be set, based on a weight of the patient, based on a desired patient transfer time, the speed at which a seat of the wheelchair can slide and rotate and/or any combination thereof.

The mattress 635 is coupled to the bed frame 610. The head mattress portion 670 can be coupled to the head bed frame portion 615. The head mattress portion 670 can be coupled to the head bed frame portion 615 by a first hinge, Velcro, snaps, grommets/hook, rod/loops and/or zippers (living hinge being the fabric). The foot mattress 675 can be coupled to the foot bed frame portion 620. The foot mattress portion 675 can be coupled to the foot bed frame portion 620 by a second hinge, Velcro, snaps, grommets/hook, rod/loops and/or zippers (living hinge being the fabric).

The first conveyor spool 650*a* can be coupled to the head bed frame portion 615 and the second conveyor spool 650*b* can be coupled to the foot bed frame portion 620. The conveyor 645 can be coupled to the first and second spools 650*a*, 650*b* such that the conveyor 645 extends from first spool 650*a* over a top surface of the mattress 635 to the second spool 650*b*. The patient can be moved towards a foot portion of the bed by rotating the spools 650*a*, 650*b* clockwise (looking onto a right side of the bed). The patient can be moved towards a head portion of the bed by rotating the conveyor spools counter clockwise looking onto a right side of the bed.

In some embodiments, the first and second spool 650*a*, 650*b* are coupled to the head bed frame portion 615 and the foot bed frame portion 620, the foot bed frame portion 620 and the stationary bed frame portion 625, or various combinations thereof. In some embodiments, a detectable indicator (not shown) is coupled to the conveyor 645 to denote a length the conveyor has to translate towards the first spool or the second spool. In some embodiments, the detectable indicator measures a position of the conveyor 645 to the first spool 650*a* and the second spool 650*b*.

In some embodiments, a conveyor guide 640 is coupled to the conveyor 645 and the mattress 635 to position the conveyor 645 at a desired position on the mattress 635. The conveyor guide 640 can assist in keeping the conveyor 645 on its desired track. In some embodiments, the conveyor guide 640 restricts movement of the conveyor 635 to translation in a direction of the first axis 655 extending along the length of the bed.

Figure 7:
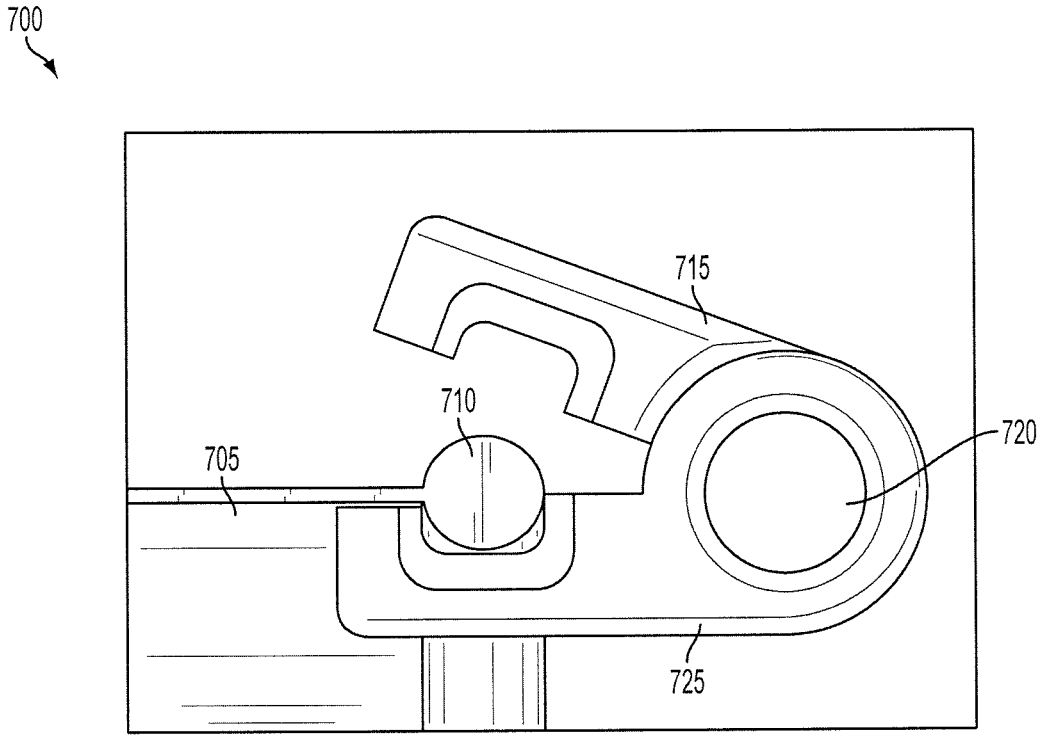
FIG. 7 is a diagram showing a sectional view of a conveyor guide, according to an illustrative embodiment of the invention.

FIG. 7 is a diagram 700 showing a sectional view of a conveyor guide, according to an illustrative embodiment of the invention. The diagram 700 is a conveyor guide assembly and includes a conveyor 705, an edge of the conveyor 710, a clamp 715, a splined interface 725, and a compression spring 720. An edge of the conveyor 710 can be restrained within the clamp 715. When the compression spring 720 is in a first position, the splined interface 725 can disengage from the clamp 715. When the splined interface 725 disengages from the clamp 715, the edge of the conveyor 710 is released. When the compression spring 720 is in a second position, the splined interface 725 can engage with the clamp 715. When the splined interface 725 engages with the clamp 715, the conveyor mating portion 710 can be restrained. When the edge of the conveyor 710 is coupled to the conveyor guide the conveyor movement is restricted (e.g., along a length of a bed, as described above in FIG. 6).

In some embodiments, the conveyor mating portion 710 has a bead that mates with the clamp 715. In some embodiments, the edge of the conveyor 710 is a first mating portion, and the clamp 715 includes a second mating portion. The conveyor mating portion 710 and the clamp 715 mate such that the first mating portion and the second mating portion connect to secure the conveyor 705 to the conveyor guide 700. The conveyor guide 700 can have other configurations as well, to restrict the conveyor 705 to move in one direction, in accordance with principles of the present invention.

Figure 8:
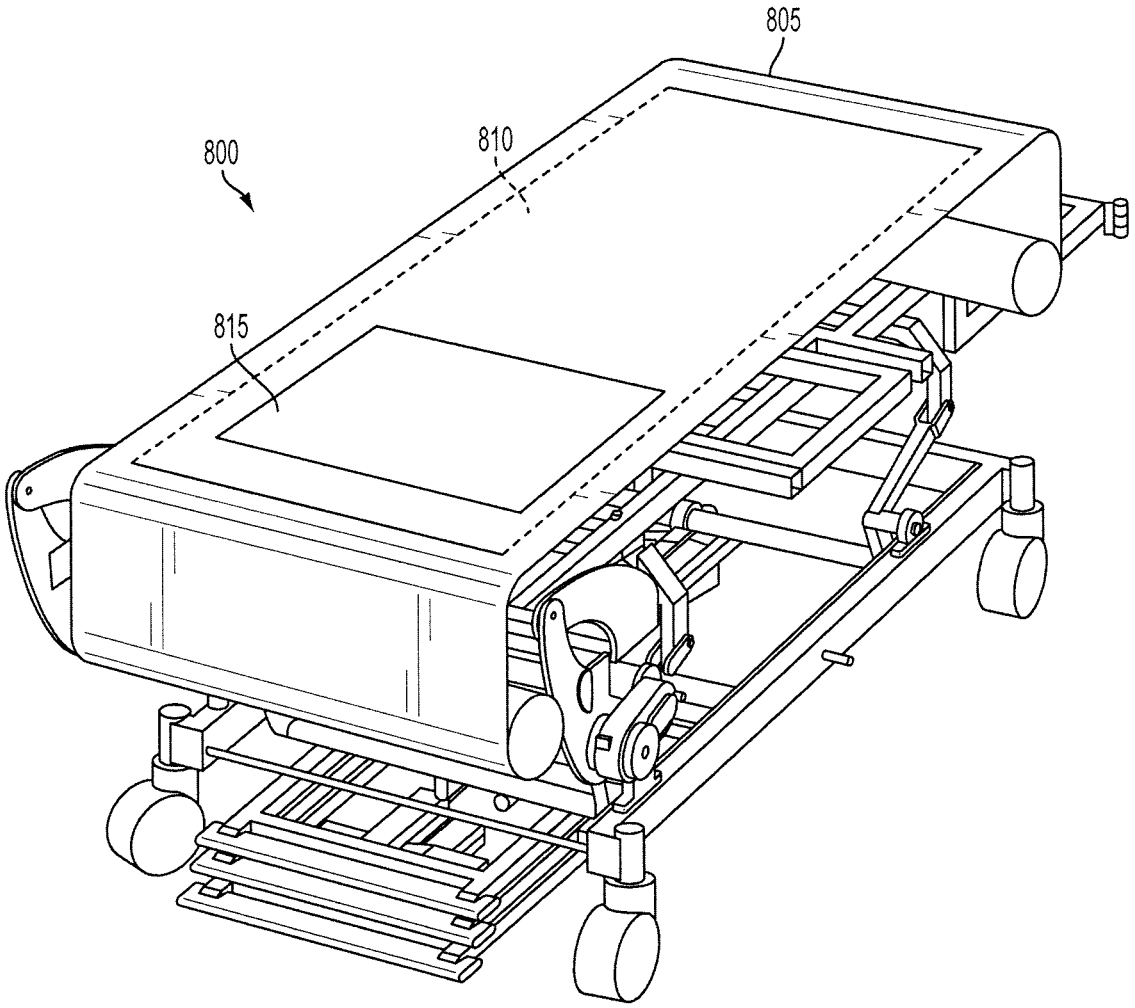
FIG. 8 is a diagram showing a perspective view of a conveyor and sheet, according to an illustrative embodiment of the invention.

FIG. 8 is a diagram 800 showing a perspective view of a conveyor and a sheet, according to an illustrative embodiment of the invention. A conveyor sheet 810 is coupled to a conveyor 805. In some embodiments, the conveyor sheet 810 is coupled to the conveyor 805 by a zipper. Zippering the conveyor sheet 810 to the conveyor 805 can allow for easily installation and removal of the sheet, as well as simplicity in laundering the sheet. In some embodiments, a slot 815 is included in the conveyor sheet 810 to allow for an incontinence pad (not shown).

Figure 9:
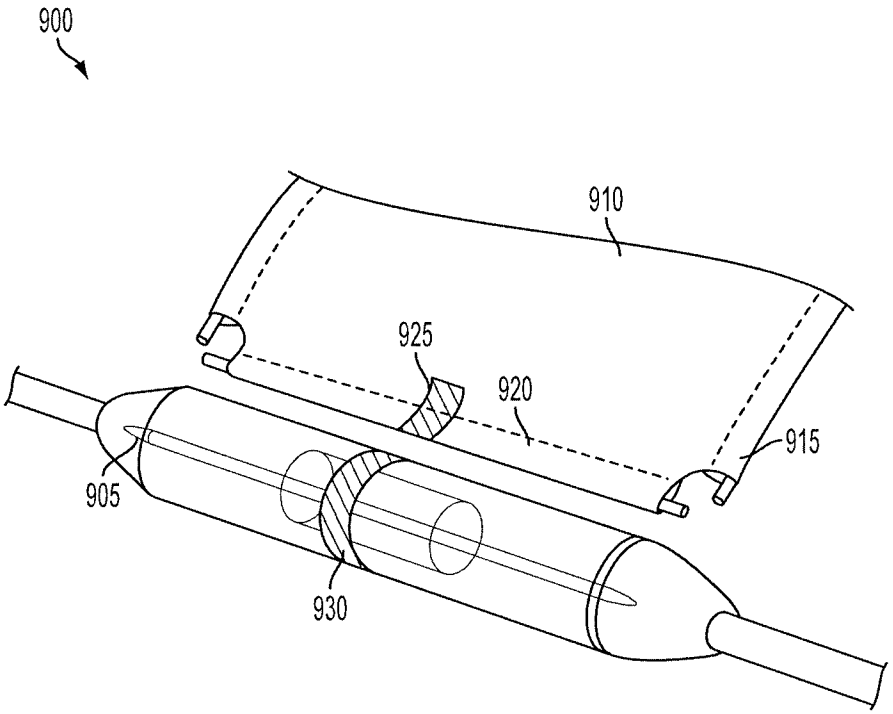
FIG. 9 is a diagram showing a perspective view of a spool and a conveyor, according to an illustrative embodiment of the invention.

FIG. 9 is a diagram 900 showing a perspective view of a spool 905 (e.g., first conveyor spool 650*a* and/or second conveyor spool 650*b*, as described above in connection with FIG. 6), and a conveyor 910, (e.g., conveyor 645, as described above in connection with FIG. 6) according to an illustrative embodiment of the invention. The conveyor 910 can have a first mating portion 915 (e.g., a set of beads) and a first mark 925. The first mating portion 915 can be coupled to an end of the conveyor 910.

The spool 905 can have a second mating portion 920 (e.g., cylindrical groove) and a second mark 930. The second mating portion 920 can connect with the first mating portion 915 such that the spool 905 and the conveyor 900 attach. When attaching the spool 905 and the conveyor 900 the first mark 925 and the second mark 930 can indicate when the spool 910 and the conveyor 900 are in an aligned position when attaching the spool 905 and the conveyor 900.

It will be apparent to one of ordinary skill in the art, that first mating portion can be included on both ends of the conveyor such that a first end of the conveyor can connect with a first spool that includes a first spool mating portion, and that the second end of the conveyor can connect with a second spool that includes a second spool mating portion.

Figure 10:
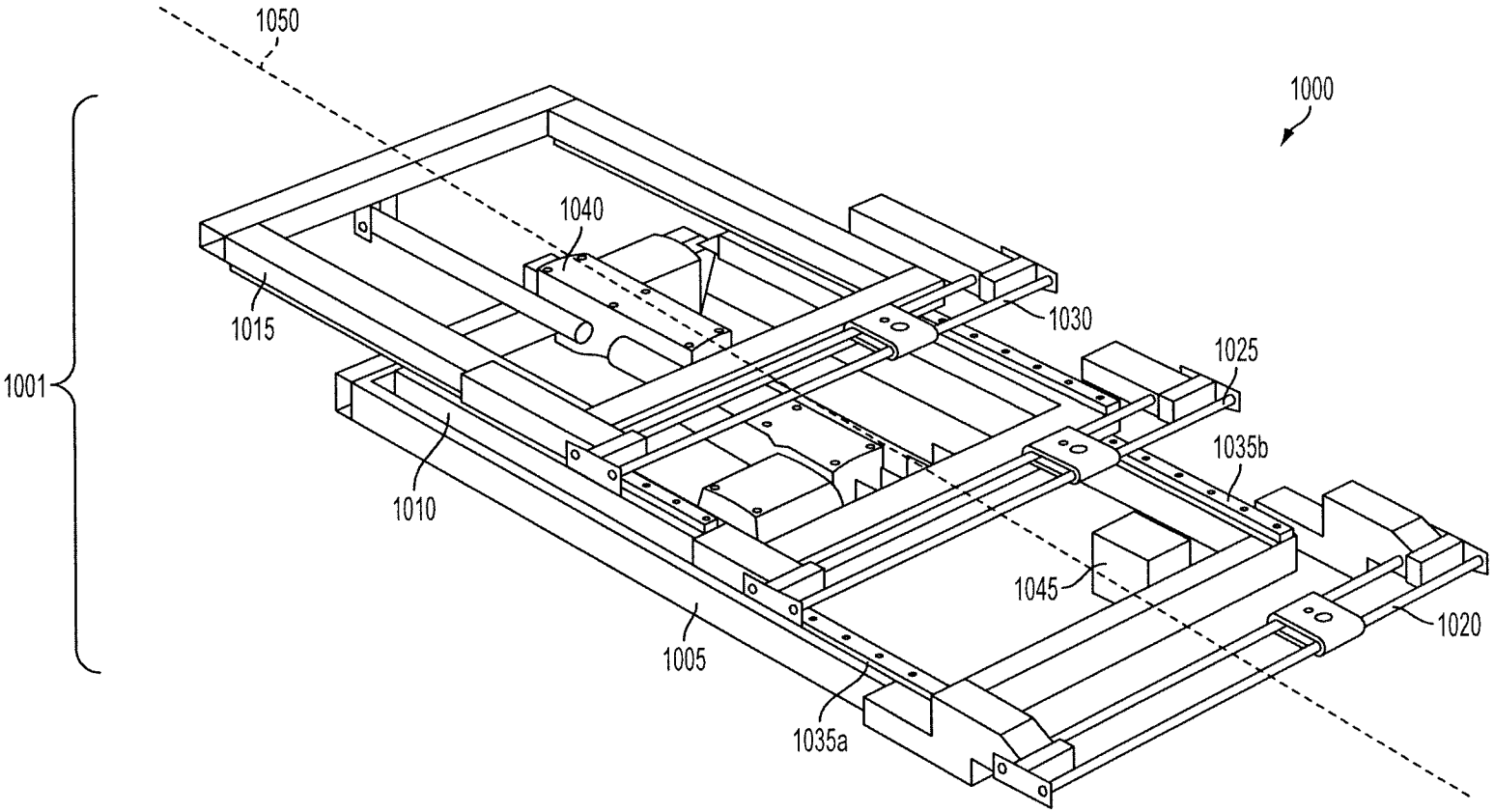
FIG. 10 is a diagram showing a perspective view of a docking assembly, according to an illustrative embodiment of the invention.

FIG. 10 is a diagram 1000 of a docking assembly. The docking assembly 1001 can include a first frame 1005 (e.g., stationary frame), a second frame 1010 (e.g., a seat slide frame), a third frame 1015 (e.g., a seat rotation frame), a first latch 1020 (e.g., a stationary frame latch), a second latch 1025 (e.g., a seat slide frame latch), a third latch 1030 (e.g., a seat rotation frame latch), several sliding assemblies 1035*a*, 1035*b*, generally 1035, actuator 1040, a release mechanism 1045 (e.g., seat slide and seat rotation frame latch release), and one or more sensors/switches (not shown).

The first frame 1005 can be coupled to the first latch 1020. The first 1005 can stabilize an apparatus (e.g., wheelchair) when the apparatus is latched to the first latch 1020. The interaction between the docking assembly and the apparatus is described in examples shown below in FIGS. 13A-13F.

The second frame 1010 can be coupled to the second latch 1025. The second can be slidably mounted on top of the second frame 1005. The second frame 1010 can translate along a length of the first frame 1005. The second frame 1010 can translate a seat of the apparatus when the apparatus is attached to the second latch 1025.

The third frame 1015 can be coupled to the third frame latch 1030. The third frame can be slidably mounted on top of the second frame 1025. The third frame 1015 can slide along a length of the second frame 1010. The third frame 1015 can rotate a seat of the apparatus when the apparatus is attached to the third latch 1025.

The actuator 1040 can translate the second frame 1010 a first distance in a direction along the first axis 1050 relative to the first frame 1005, a third frame 1015 a second distance in a direction along the first axis 1050 relative to the second frame, or any combination thereof. The second frame latch 1025 and third latch 1030 can release the wheelchair when it is latched to the second latch 1025 and/or the third latch 1030. In some embodiments, a robotic arm is coupled to the docking assembly or bed such that the robotic arm automatically extends from a foot of the bed, connects to the apparatus and draws the apparatus towards the bed. In some embodiments, a robot connects to the apparatus and tows the apparatus towards the bed.

In some embodiments, the second frame 1010 is mounted on the first frame 1005 by a sliding assembly 1035*s*. In some embodiments, the third frame 1015 is mounted on the second frame 1010 by a sliding assembly 1035*b*. The sliding assemblies 1035 can be any sliding mechanisms known in the art.

The docking assembly 1000 can detachably attach to an apparatus for stabilization. When the docking assembly 1000 is attached to the apparatus, the apparatus can remain substantially stationary. The apparatus can be at least a chair, rollable chair, wheelchair, or walker.

The docking assembly 1000 can detachably attach to a bed, as shown, for example, in FIG. 1 above. When the docking assembly 1000 is attached to a bed, it can also attach to the apparatus to stabilize that apparatus with respect to the bed. In various embodiments, the docking assembly 1000 docks any apparatus that needs to be stabilized.

The docking assembly 1000 can be enclosed in a housing (not shown). In various embodiments, a housing (not shown) surrounds the first frame 1005, the second frame 1010, the third frame 1015, and/or any combination thereof. In some embodiments, the docking assembly 1000 and/or the docking assembly housing is coupled to a transfer bed such that it is located underneath the bed to minimize the risk of a person walking into or tripping on the docking assembly 1000.

In some embodiments, a first controller that includes a first sensor is coupled to the bed, and a second controller that includes a second sensor is coupled to the wheelchair. The first controller receives an indication that a patient is to be transferred to the bed. The first controller transmits a signal to the second controller to begin moving the patient towards the bed. The first sensor and the second sensor each continually sense the position of the wheelchair with respect to the bed and update the second controller, such that the second controller automatically guides the wheelchair to a foot end of the bed for docking.

Figure 11:
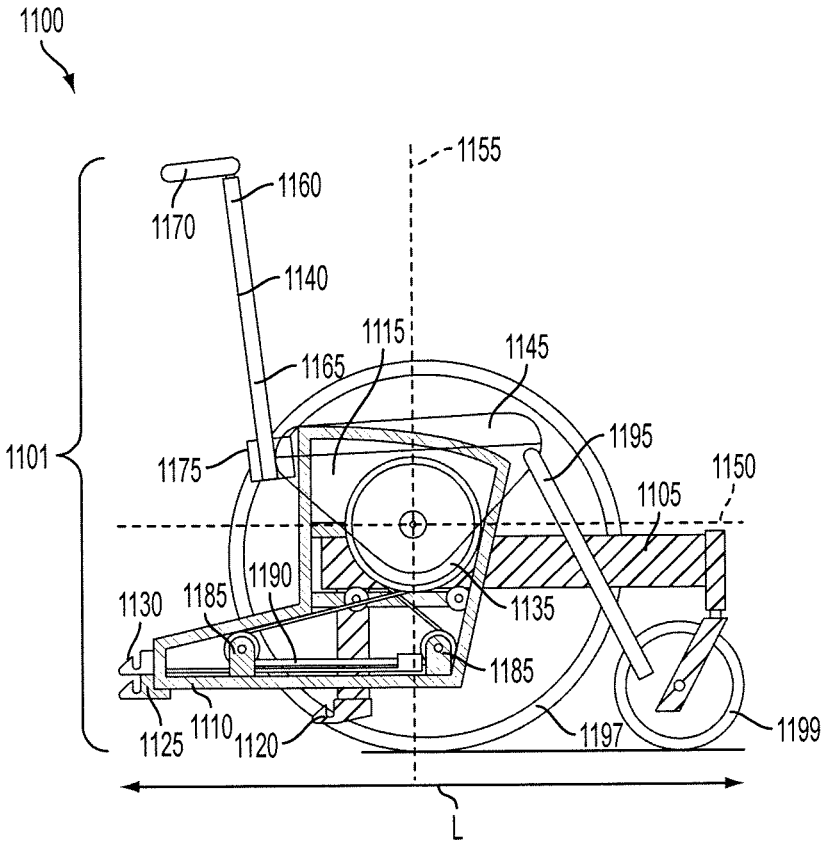
FIG. 11 is a diagram showing a section view of a rollable chair, according to an illustrative embodiment of the invention.

FIG. 11 is a diagram 1100 showing a section view of a rollable chair 1101, according to an illustrative embodiment of the invention. The rollable chair 1101 includes a first frame 1105 (e.g., wheel frame rail/chassis), a second frame 1110 (e.g., a mechanical frame/slide frame), a third frame 1115 (e.g., seat frame/rotation frame), a first hook 1120 (e.g., a mechanical frame/slide frame hook), a second hook 1125 (e.g., seat frame hook/rotation frame hook), a third hook 1130 (e.g., wheel frame hook/chassis hook), a seat frame pulley 1135, a chair back 1140 (e.g., back rest), a top end of the chair back 1160, a bottom end of the chair back 1165, chair back guide 1175, a seat 1145, a push handle 1170, one or more idler pulleys 1185, a cable 1190, a leg ramp 1195, and various other elements as shown in FIG. 11.

The first frame 1105 is coupled to the first hook 1120. The first frame 1105 can stabilize the rollable chair 1101 when the first hook 1120 is engaged. For example, the first hook 1120 can be engaged with a latch of a docking mechanism (e.g., the docking assembly as described above in FIG. 10).

The second frame 1110 is coupled to the first frame 1105 and the second hook 1120. The second frame 1110 translates a desired distance relative to the first frame 1105 along first axis 1150 that extends along a length of the rollable chair 1101, when the second hook 1125 is pushed or pulled. Translating the second frame 1110 along the first frame 1105 allows a seat 1145 of the rollable chair to translate relative to the first frame 1105 along the first axis 1150. The second hook 1120 can be engaged with a latch of a docking assembly. For example, the second hook 1120 can be engaged with a docking mechanism (e.g., the docking assembly as described above in FIG. 10.

The third frame 1115 is coupled to the second frame 1110, a seat frame pulley 1135, and a third hook 1130. The seat frame pulley 1135 rotates the seat 1145 to a desired angle about a second axis 1155 that is perpendicular to the first axis 1150, when the third hook 1130 is pushed or pulled. The third hook 1130 can be engaged with a latch of a docking assembly. For example, the third hook 1130 can be engaged with a docking mechanism (e.g., the docking assembly as described above in FIG. 10). In some embodiments, the seat frame pulley is any rotation mechanism known in the art.

In various embodiments, the first hook 1120, second hook 1125 and/or third hook 1130 are any mechanism known in the art that allows the first frame, second frame and third frame to be actuated.

In some embodiments, the second frame translates via plain bearing/track and/or roller/track combinations, or any other mechanism as known in the art.

In some embodiments, the desired distance is between 0 inches and 9.0 inches. The desired distance can be based on a weight of a patient, a height of the patient, a distance between a bed the patient is transferred to and the seat of the rollable chair, or any combination thereof.

In some embodiments, the desired angle is between 105 degrees to 120 degrees. In some embodiments, the desired angle is between 110 degrees and 115 degrees. The desired angle can be based on a speed of a conveyor (e.g., the conveyor as described above in FIG. 6) that is attached to a bed a patient is transferred to moves.

The chair back includes a top end 1160 and a bottom end 1165. The chair back 1140 is coupled to the seat 1145 via the chair back guide 1175. The chair back 1140 can translate along the chair back guide 1175. A push handle 1170 is coupled to the top end 1160 of the chair back 1140.

The chair back 1140 can be in a first position (e.g., patient back support position) when the push handle 1170 is rotated such that the chair back is in a locked position. In the first position, the top end of the chair back 1160 is a vertical distance above the seat 1145 of the chair and the bottom end of the chair back 1165 is substantially parallel to the seat 1145. The chair back 1140 can be in a second position (e.g., stored position) when the push handle 1170 is rotated such that the chair back is in an unlocked position. In the second position, the top end of the chair back 1160 is substantially vertically even with the seat 1145 of the rollable chair. The chair back guide 1175 allows the chair back 1140 to translate along a second axis 1155 that is perpendicular to the first axis 1150 such that the chair back can move from the first position to the second position, or any position in-between.

Figure 12B:
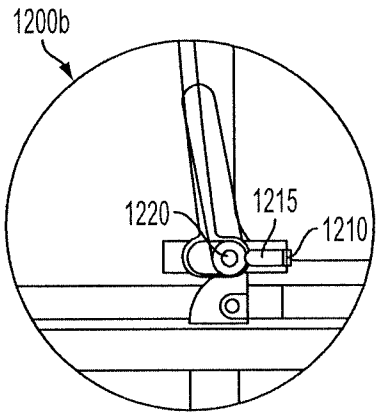
FIG. 12B is a diagram showing a section view of a locking mechanism of a rollable chair in a locked position, according to an illustrative embodiment of the invention.
Figure 12A:
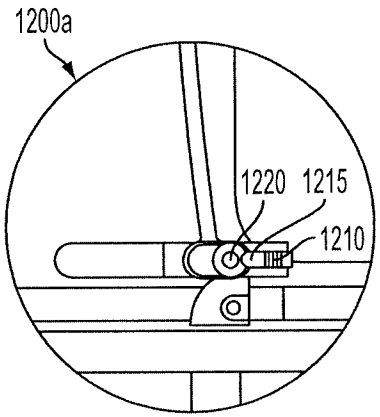
FIG. 12A is a diagram showing a section view of a locking mechanism of a rollable chair in an unlocked position, according to an illustrative embodiment of the invention.
Figure 12:
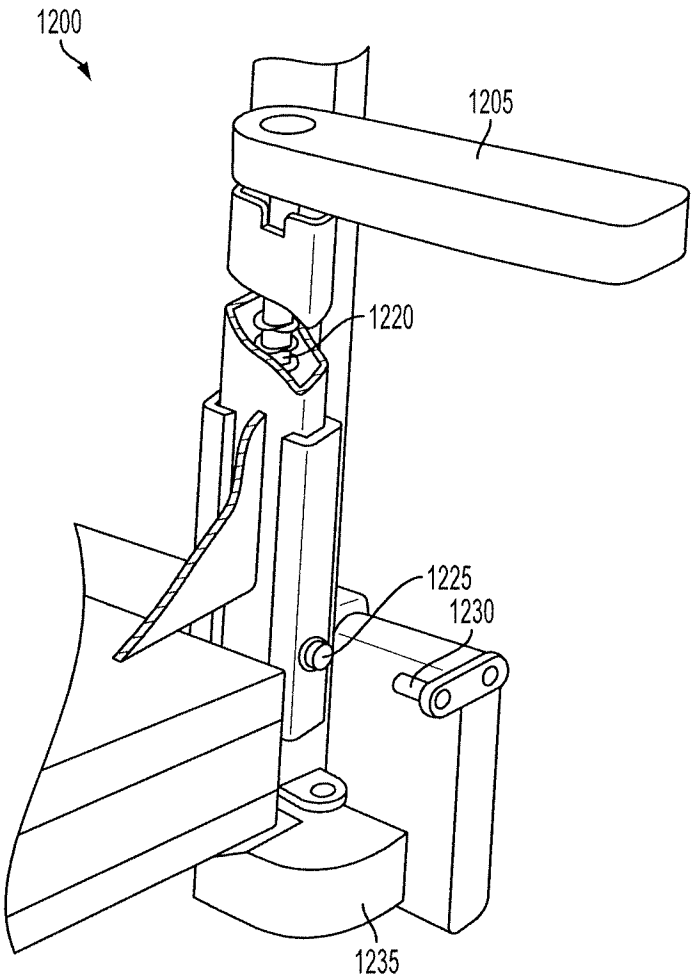
FIG. 12 is a diagram showing a perspective view of a locking mechanism of a rollable chair, according to an illustrative embodiment of the invention.

The chair back 1140 can switch between a locked position and an unlocked position via an interlock system. FIG. 12, FIG. 12A, and FIG. 12B are diagrams of an interlock system 1200 of the rollable chair 1101, according to illustrative embodiments of the invention. The interlock system 1200 allows a chair back of a rollable chair (e.g., the chair back of the rollable chair described above in FIG. 11) to move between a first position and a second position (e.g., the first position and the second position described above in FIG. 11). The interlock system 1200 also allows a seat of the rollable chair (e.g., the seat of the rollable chair described above in FIG. 11) to rotate or be locked into a position such that the seat can not rotate.

The interlock system 1200 includes a push handle 1205, a first cam 1220, a first pin 1230, a second pin 1225, a second cam 1235, a compression spring 1210, and bullet pin 1215.

The push handle 1205 is coupled to the chair back of the rollable chair. When the push handle is rotate in a direction parallel to a first axis (e.g., the first axis 1150, as described above in FIG. 11), the bullet pin 1215 pushes into the compression spring 1210 which locks the first cam 1220 into place, thus preventing the chair back from translating. When the push handle 1205 is rotated in a direction perpendicular to the first axis, the bullet pin 1215 pulls backs from the compression spring 1210, thus releasing the first cam 1220, thus allowing the chair back to translate. Diagrams 1200*a* and 1200*b* show the first cam 1220, bullet pin 1215, and compression spring 1210 in a locked and unlocked position.

The first pin 1230 is coupled to a first frame of the rollable chair (e.g., the first frame as described above in FIG. 11); the second pin 1225 is coupled to the chair back. When the first pin 1230 is pushed in all the way (e.g., the first frame of the rollable chair translates towards a bed), the first pin 1230 pushes the bullet pin 1215, thus releasing a) the compression spring 1210 and the first cam 1220 and b) allowing the second cam 1235 to move when pressure is exerted on the second cam 1235 by for example, the seat rotating in a direction towards the second cam 1235.

Returning to FIG. 11, the seat frame pulley 1135 (e.g., bi-directional linear pulley or driven pulley) is coupled to the third frame 1115 and the second frame 1110. A cable 1190 is threaded around one or more idler pulleys 1185*a*, 1185*b*, generally, 1185. The idler pulleys 1185 can be coupled to the second frame 1110. The seat frame pulley 1135 can allow for the seat of the rollable chair 1101 to translate to a desired position, and rotate to a desired angle. The seat frame pulley 1135 can rotate in a first direction, causing the seat 1145 to translate to a first desired position and rotate to a first desired angle. The seat frame pulley 1135 can rotate in a second direction, causing the seat 1145 to translate to a second desired position and rotate to a second desired position. The seat frame pulley 1135 can translate and rotate the seat in a clockwise and a counter-clockwise direction, eliminating the need for a spring to rotate the seat back into a neutral position after transferring a patient.

Figure 11A:
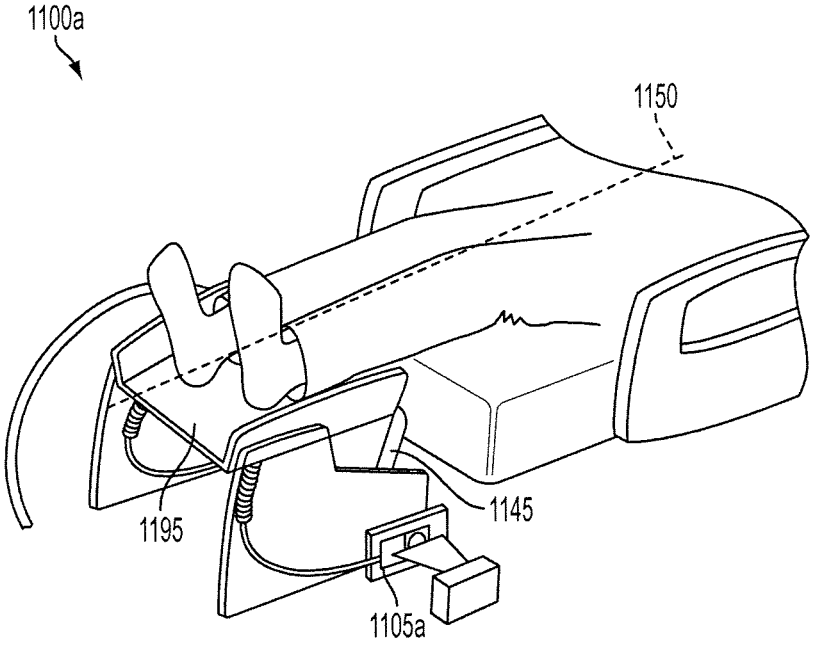
FIG. 11A is a diagram showing a perspective view of a leg ramp of a rollable chair, according to an illustrative embodiment of the invention.

The leg ramp 1195 (e.g., leg rest) of the rollable chair is coupled to the seat 1145. FIG. 11A is a diagram 1100*a* showing a perspective view of a leg ramp of a rollable chair, according to an illustrative embodiment of the invention. The leg ramp 1195 (e.g. leg rest) of the rollable chair is coupled to the seat 1145 such that a) it is positioned underneath the seat 1145 of the rollable chair when a patient enters or exits the rollable chair 1101 and b) it rotates with the seat 1145 during patient transfer. When transferring a patient from a bed to the rollable chair, the seat of the rollable chair is substantially perpendicular to the first axis 1150 and the leg ramp is substantially parallel to the first axis 1150. When the weight of the patient's legs touch the leg ramp 1195 and exerts a substantial enough force onto the leg ramp 1195 a spring (not shown) coupled to the leg ramp 1195 compresses. The spring compression is detected by a sensor such that a patient entering the rollable chair is detected, allowing, for example, the seat of the rollable chair 1145 to begin to rotating. In some embodiments, the spring is a spring loaded plunger that is connected to a sliding flag inside a shutter box 1105*a*. When the spring loaded plunger is compressed, the flag inside the shutter box 1105*a* moves and the change in optical light is detected by the sensor. In various embodiments, the sensor is an optical sensor or any sensor known in the art.

In some embodiments, the chair does not include leg ramp.

Returning to FIG. 11, the rollable chair 1101 can include one or more rear wheels 1197 and one or more front wheels 1199. The rear wheels 1197 and the front wheels 1199 can be the same size as a conventional wheelchair known in the art. In some embodiments, the rollable chair 1101 is a wheelchair.

Figure 12C:
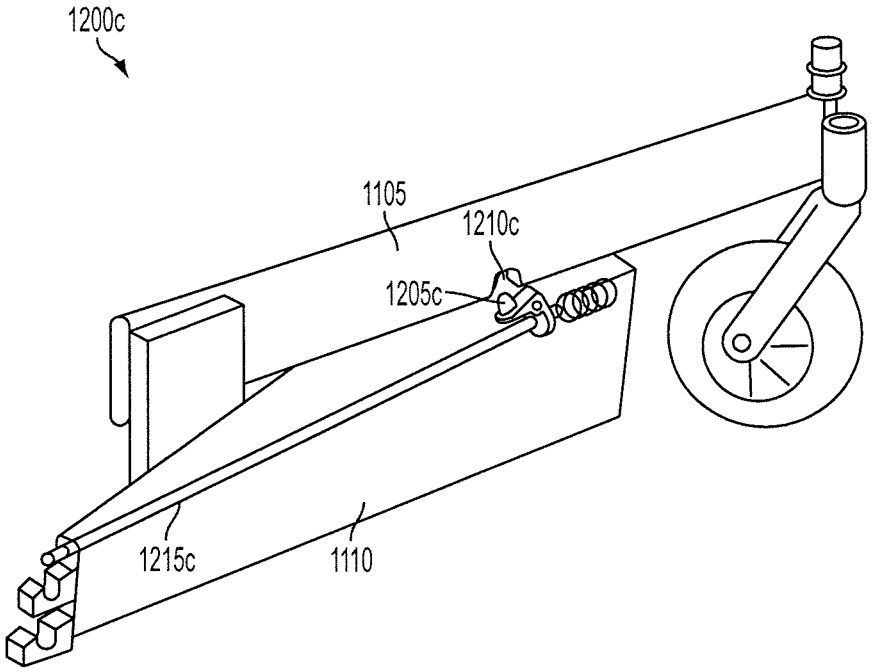
FIG. 12C is a diagram showing a perspective view of a locking mechanism of a rollable chair to a docking assembly, according to an illustrative embodiment of the invention.

In some embodiments, the rollable chair 1101 includes a locking mechanism to prevent the second frame 1110 of the rollable chair from translating with respect to the first frame 1105 of the rollable chair, unless the rollable chair is docked (e.g., docked to the docking assembly as shown below in FIG. 13D). FIG. 12C is a diagram 1200*c* showing a locking mechanism of a rollable chair (e.g., the rollable chair described in FIG. 11), according to an illustrative embodiment of the invention. The locking mechanism includes a protrusion 1205*c* (e.g., locking pawl), a notch 1210*c*, and a spring-loaded rod 1215*c*.

The protrusion 1205*c* (e.g., locking pawl) and the spring-loaded rod 1215*c* are coupled to a second frame 1110 in FIG. 11 of the rollable chair. The protrusion 1205*c* indexes into a corresponding notch 1210*c* on the first frame 1105 of the rollable chair when preventing the second frame 1110 from moving (e.g., translating) with respect to the first frame 1105 (e.g., when the second frame is not coupled to a docking assembly). Once the rollable chair is coupled to a docking assembly, the docking assembly compresses the spring-loaded rod 1215, thus rotating the protrusion 1205*c* out of the notch 1210*c*. When the protrusion 1205*c* is out of the notch, the second frame 1110 can move (e.g., translate) with respect to the first frame 1105. It will be easily apparent to one of ordinary skill in the art that one or more locking mechanisms can be coupled to rollable chair to prevent the second frame 1110 from translating with respect the first frame 1105, when the rollable chair is not docked.

FIGS. 13A-13F are diagrams 1300*a*, 1300*b*, 1300*c*, 1300*d*, 1300*e*, and 1300*f* respectively showing section views of a rollable chair docking to a docking assembly, according to illustrative embodiments of the invention.

Figure 13A:
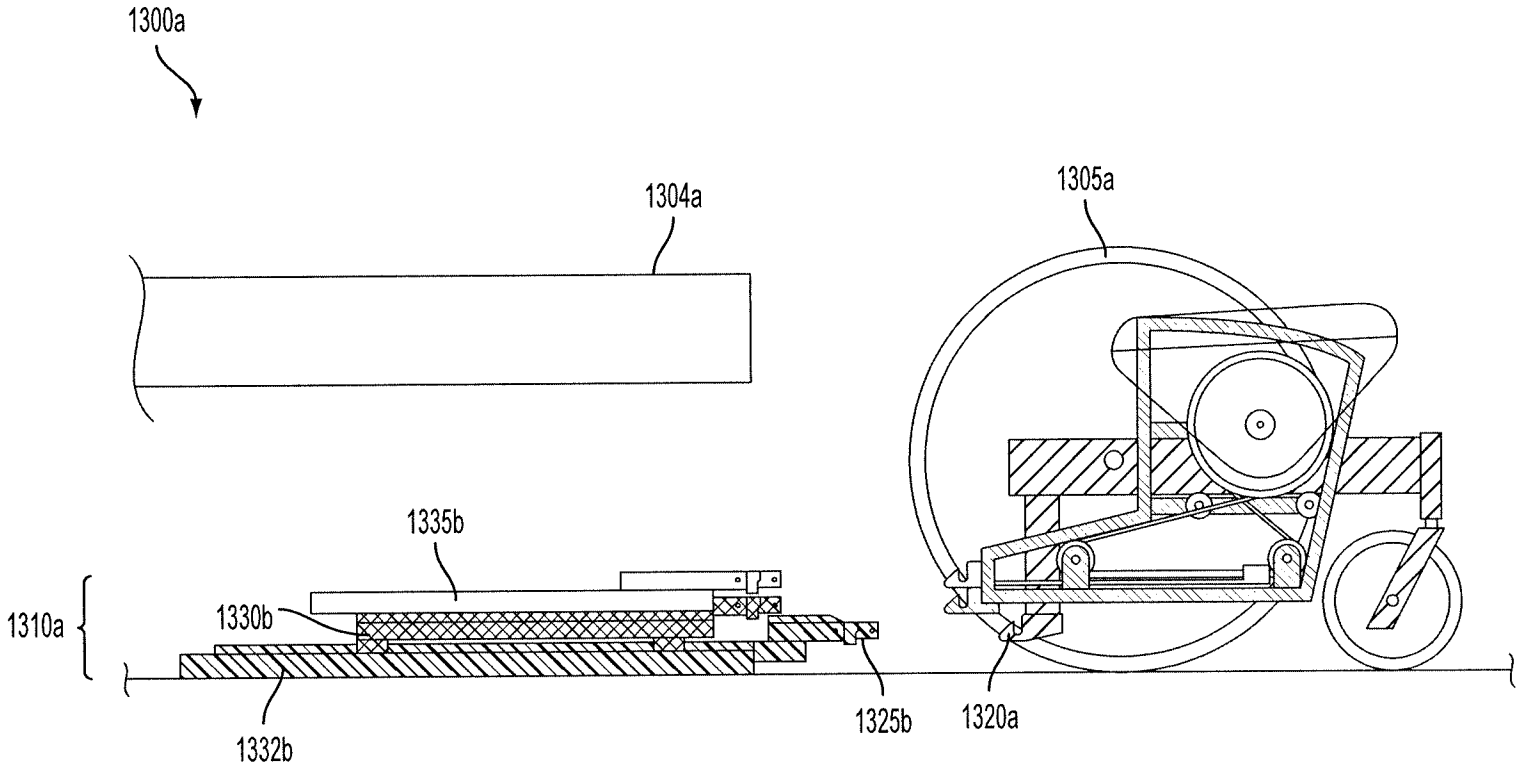
FIGS. 13A-13F are diagrams showing section views of a rollable chair docking to a docking assembly, according to an illustrative embodiment of the invention.
Figure 13B:
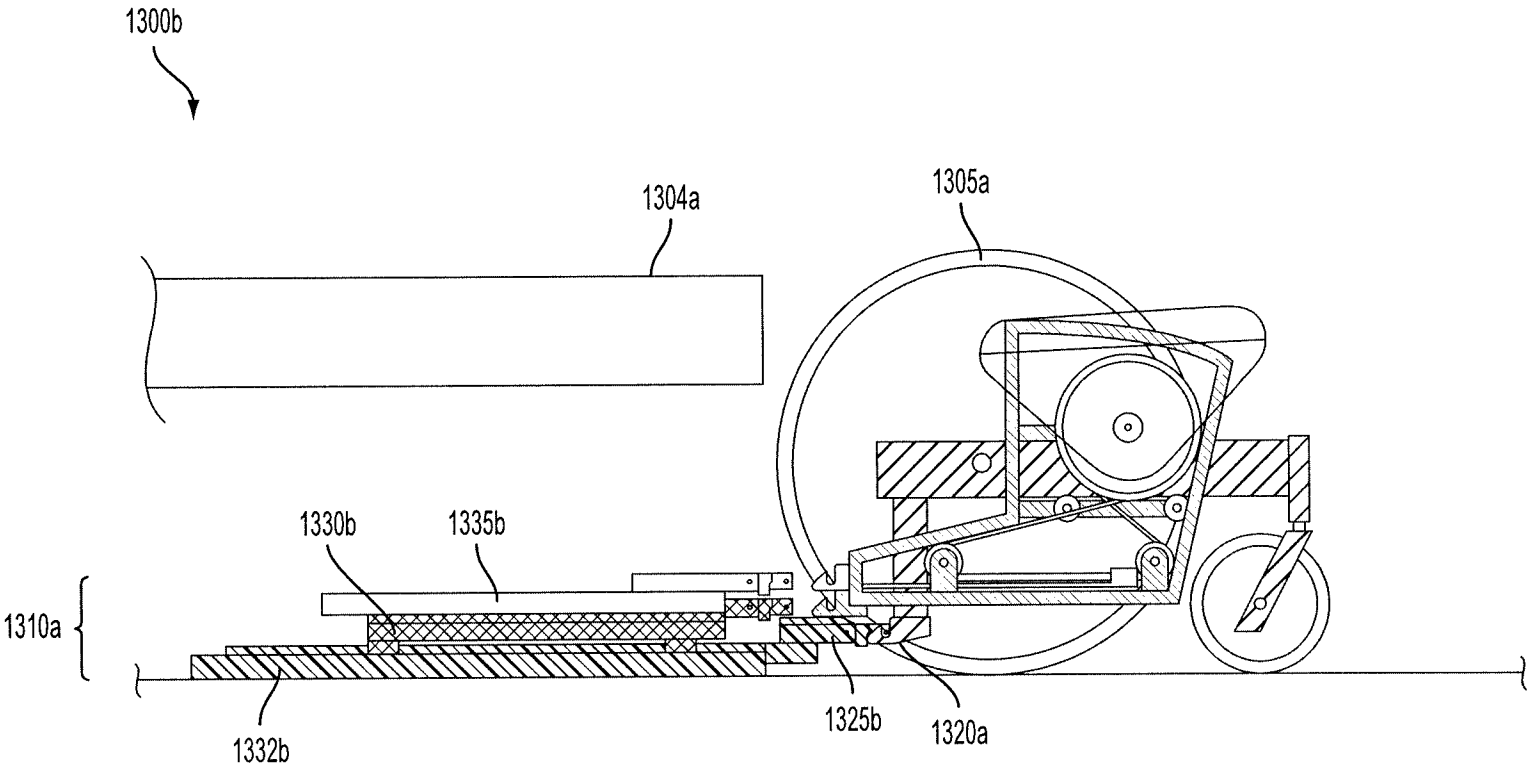

FIG. 13A shows a diagram 1300*a*, a rear of the rollable chair 1305*a* is rolled towards a docking assembly 1310*a* and bed 1304*a*. A seat sliding frame 1330*b* and a seat rotation frame 1335*b* of the docking assembly 1310*a* are positioned such that a stationary frame 1332*b* of the docking assembly extends a distance (e.g., 8 to 12 inches towards the wheelchair). A first frame hook 1320*a* of the rollable chair is positioned such that when the rollable chair 1305*a* reaches the docking assembly 1310*a*, the first frame hook 1320*a* latches to the stationary frame latch 1325*b* of the docking assembly, as shown in FIG. 13B. Upon sensing that the first frame hook 1320*a* of the rollable chair has latched to the stationary frame latch 1325*b* of the docking assembly, a controller (not shown) can instruct the seat sliding frame 1330*b* and the seat rotation frame 1335*b* of the docking assembly to slide towards the rollable chair.

Figure 13C:
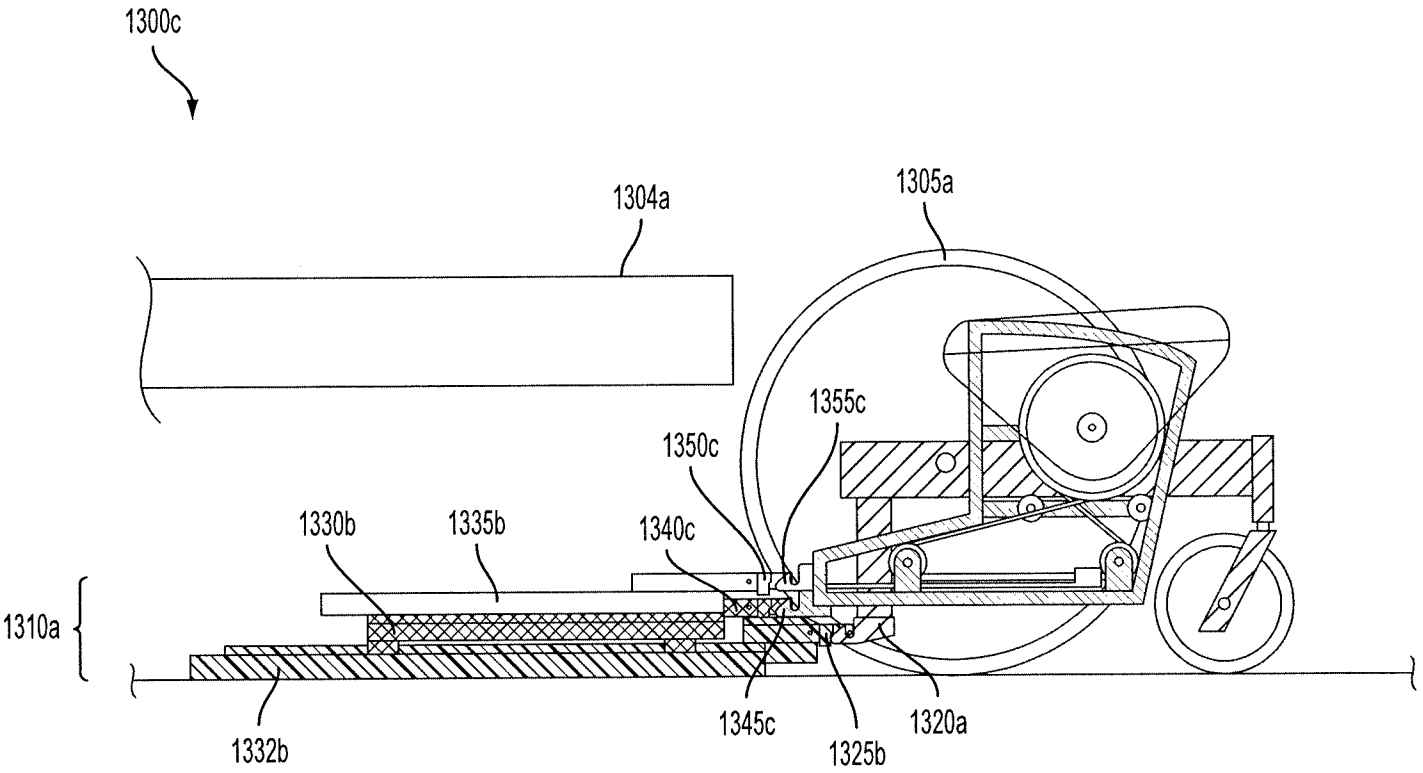
Figure 13D:
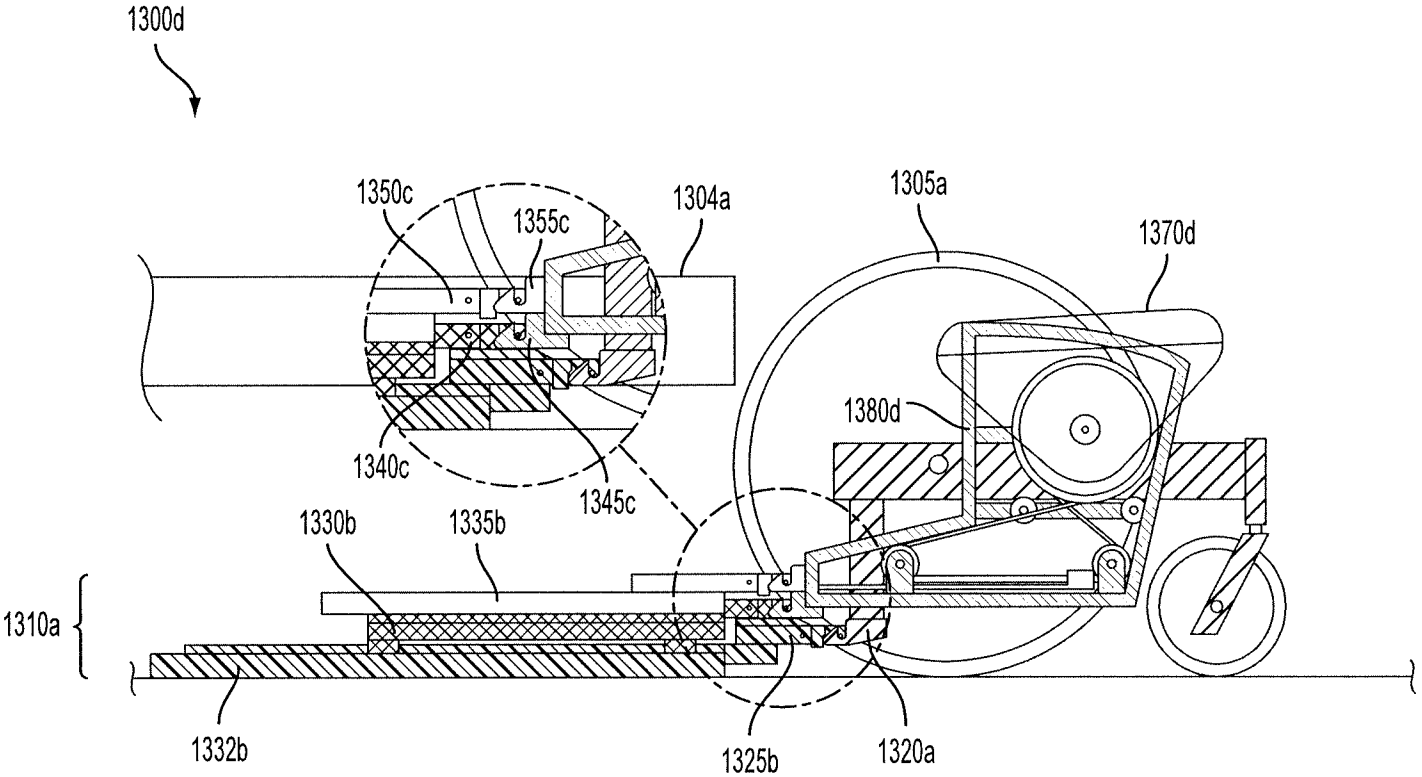

As shown in FIGS. 13C-13D the seat sliding frame 1330*b* of the docking assembly and the seat rotation frame 1335*b* of the docking assembly 1310*b* translate towards the rollable chair 1305*a*. The second frame hook 1345*c* of the rollable chair latches to the seat slide frame latch 1340*c* of the docking assembly and the third frame hook 1355*c* of the rollable chair latches to the seat rotation frame latch 1350*c* of the docking assembly.

As shown in FIG. 13D, when the seat sliding frame 1330*b* and the seat rotation frame 1335*b* of the docking assembly are latched to the rollable chair 1305*a* and positioned towards the rollable chair 1305*a*, a gap exists between the rollable chair seat 1370*d* and a mattress of the bed 1304*a*. In some embodiments, the gap between the seat 1370*d* and the mattress of the bed 1304*a* is 12 inches.

Figure 13E:
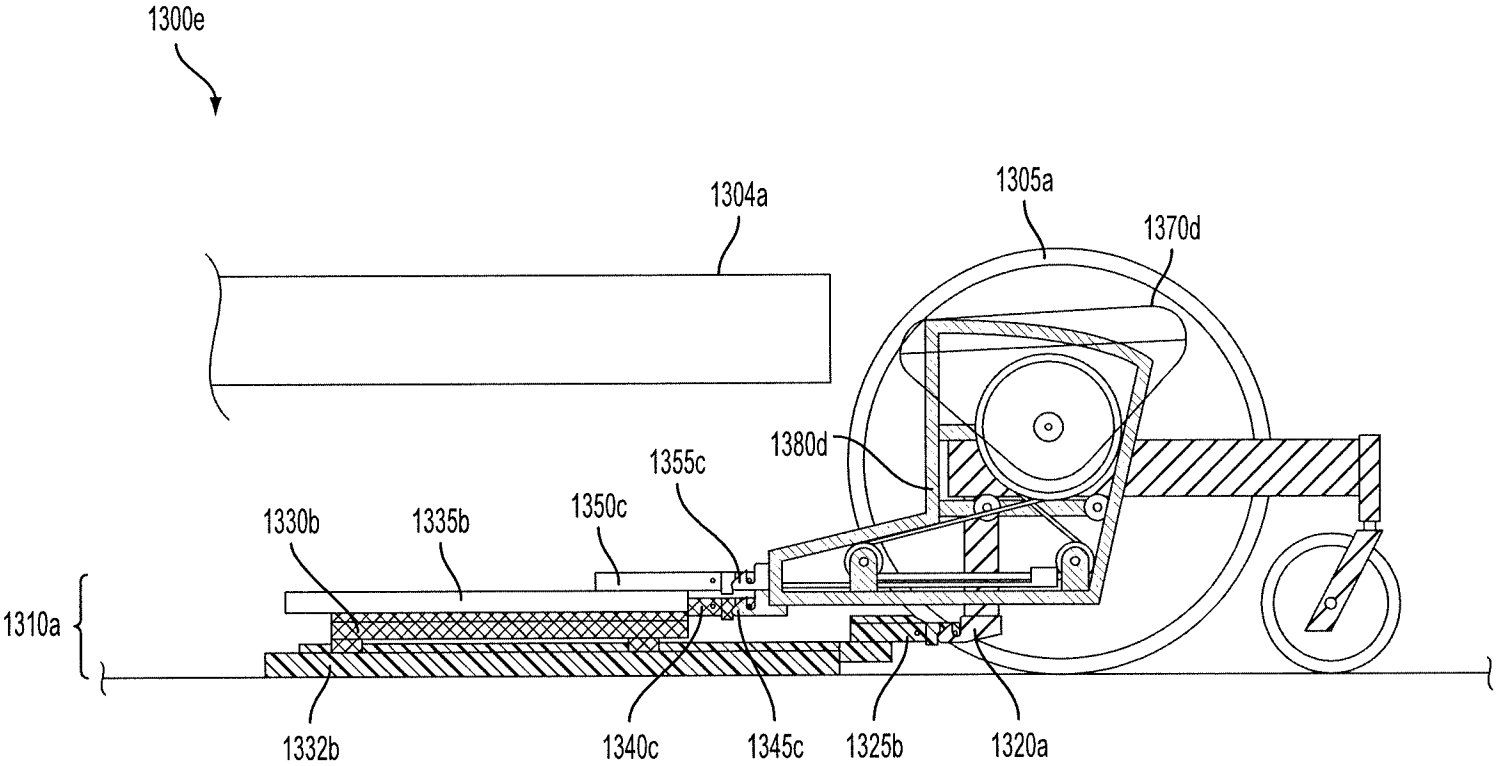

FIG. 13E is a diagram 1300*e* showing the latched docking assembly and the rollable chair translating the seat of the rollable chair towards the mattress (e.g., for the patient transfer), according to an illustrative embodiment of the invention. Upon sensing that the first frame hook 1320*a*, the second frame hook 1345*c* and the third frame hook 1355*c* of the rollable chair have latched to the stationary frame latch 1325*b*, the seat slide frame latch 1340*c*, and the seat rotation frame latch 1350*c* of the docking assembly, respectively, a controller (described below) can instruct the seat sliding frame 1330*b* and the seat rotation frame 1335*b* to slide a first distance away from the rollable chair 1305*a*. For example, the seat sliding frame 1330*b* and the seat rotation frame 1335*b* can slide a first distance of 8.5 inches away from the rollable chair 1305*a*. Sliding the seat slide frame 1330*b* away from the rollable chair 1305*a* can cause the second frame 1380*d*, and thus the seat of the rollable chair 1370*d*, to slide a distance towards the mattress. In some embodiments, the seat 1370*d* is translated toward the foot end of the bed. In some embodiments, the distance is between 0 inches and 9.0 inches. In some embodiments, the distance is about 8.5 inches. Sliding the seat slide frame 1330*b* away from the rollable chair 1305*a* can narrow the gap to a distance between the seat of the rollable chair 1370*d* and the mattress of the bed 1304*a*, thus eliminating unwanted effects caused by a larger gap. In some embodiments, the distance can be 3.5 inches. In some embodiments, the seat slide frame 1330*b* and the seat rotation frame 1335*b* translate towards a head end of the bed 1304*a* at a substantially equal rate, causing the seat of the rollable chair 1370*d* to translate towards the foot end of the bed 1304*a*. The speed at which the seat slide frame 1330*b* and the seat rotation frame 1335*b* translate can be based on a speed that the conveyor of the bed moves, or any combination thereof. In some embodiments, the seat slide frame 1330*b* and the seat rotation frame 1335*b* translate at a substantially equal rate such that a seat of the rollable chair 1370*d* translates towards the foot end of the bed.

Figure 13F:
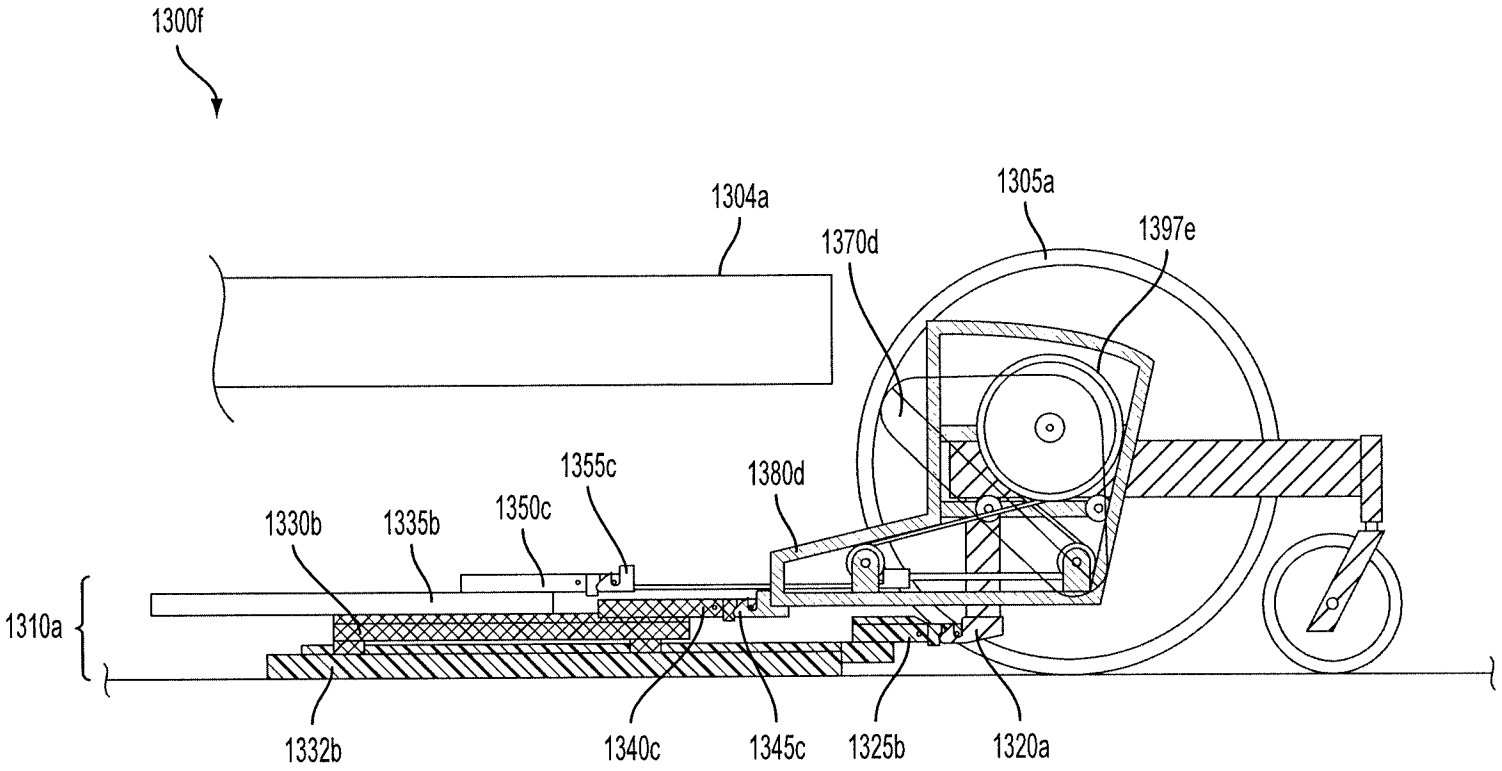

FIG. 13F is a diagram 1300*f* showing the rotation of the seat of the rollable chair 1370*d* for patient transfer, according to an illustrative embodiment of the invention. The controller (described below) can instruct the seat rotation frame 1335*b* to slide a second distance away from the rollable chair 1305*a*. For example, the seat rotation frame 1335*b* can translate a second distance of at least 9.0 inches away from the rollable chair 1305*a*. Translating the seat rotation frame 1335*b* of the docking assembly away from the rollable chair can cause the seat frame pulley 1397*e* of the rollable chair to rotate the seat frame 1335*b*, thus rotating the seat 1370*d* to a desired angle. For example, the seat frame 1335*b* can be rotated to an angle between 105 degrees to 120 degrees. The distance the seat rotation frame 1335*b* translates can be set based on a speed that the conveyor of the bed moves. In some embodiments, the seat rotation frame 1335*b* can translate a third distance towards the head end of the bed, causing the seat of the rollable chair 1370*d* to rotate to a position. Rotating the seat of the rollable chair can assist in transferring the patient from the rollable chair to the bed. The speed at which the seat rotation frame translates can be based on a speed that the conveyor of the bed moves.

In some embodiments, the entire transfer process of the patient between the bed and the rollable chair completes within 90 seconds.

When a patient is transferred from the rollable chair to the bed, the controller can instruct the docking assembly to perform the steps shown above in FIGS. 13A-13F in reverse.

Figure 14:
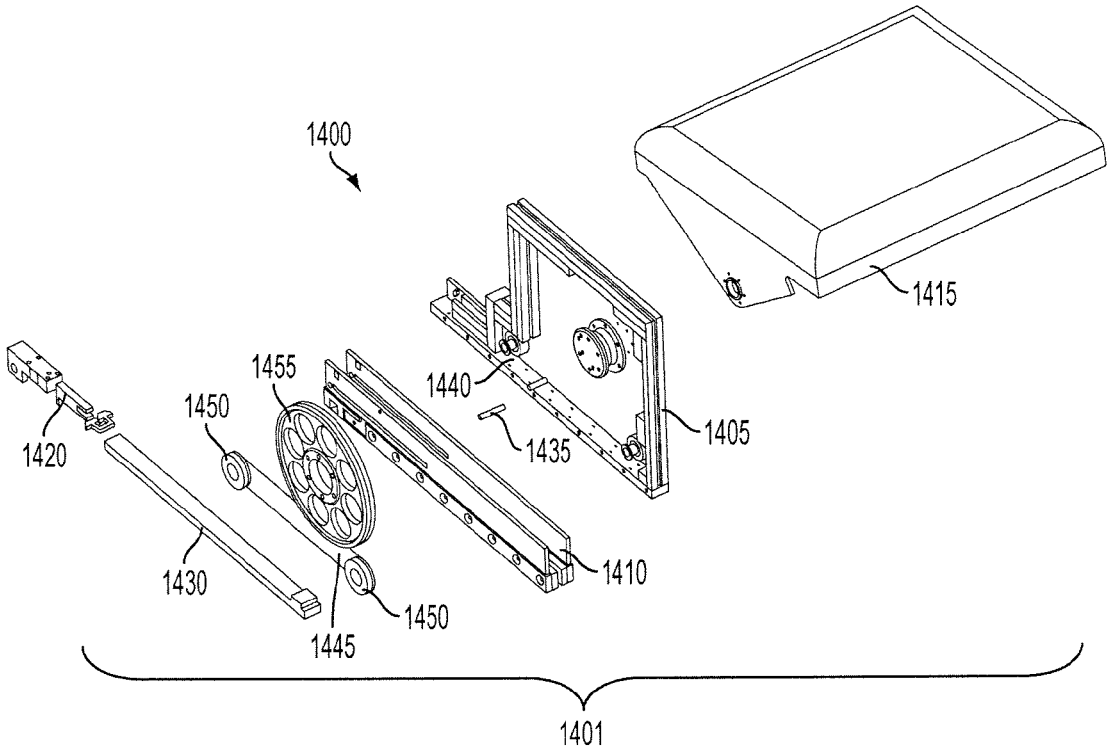
FIG. 14 is a diagram showing an exploded view of a rotation and interlock system of a seat of a rollable chair, according to an illustrative embodiment of the invention.

FIG. 14 is a diagram 1400 showing a rotation and interlock system 1401 of a seat of a rollable chair, according to an illustrative embodiment of the invention. In some embodiments, the seat frame pulley includes a rotation and interlock system 1401 of a rollable chair (e.g., the rollable chair shown in FIGS. 11-12). The rotation and interlock system 1400 of the rollable chair can be used when a patient is transferred into and out of a bed as shown in FIGS. 1-6.

Figure 14A:
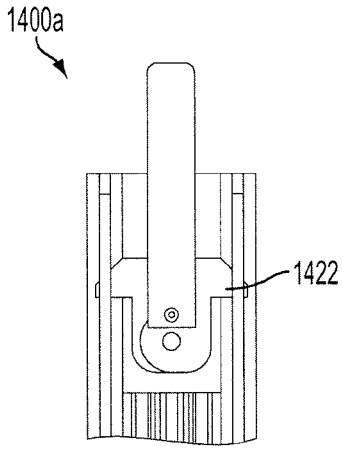
FIG. 14A is a diagram showing a section view of a latch of an interlock system engaged with a seat of a rollable chair, according to an illustrative embodiment of the invention.
Figure 14B:
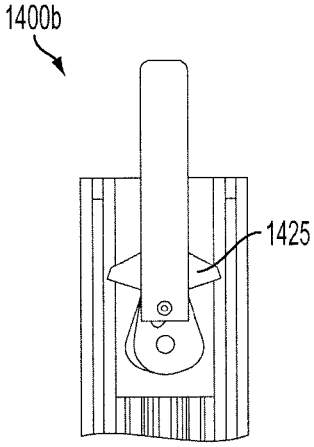
FIG. 14B is a diagram showing a section view of a latch of an interlock system disengaged with a seat of a rollable chair, according to an illustrative embodiment of the invention.

The interlock system 1401 includes a mechanical frame 1405, a stationary frame 1410, a seat frame 1415, a latch 1420, a shuttle 1430, an interlock pin 1435, a cable 1445, one or more idler pulleys 1450, and a driven pulley 1455. The second frame 1405 and the stationary frame 1410 can move in substantial unison with latch 1420 in a locked position 1422 (e.g., a patient is riding in the rollable chair as shown in FIG. 1). The rollable chair can be docked on a docking assembly (e.g., as shown above in FIGS. 13A-13F), as described above. When the rollable chair 1305*a* translates and latches onto the docking assembly as shown in FIG. 13D, the seat slide frame 1330*b* and the seat rotation frame 1335*b* of the docking assembly can translate in a direction away from the rollable chair along the first axis (e.g., the first axis 1150 shown in FIG. 11, above), thus releasing latch 1420 of the rollable chair by a rearward pull, as shown in diagrams 1400*a* and 1400*b* of FIGS. 14A-14B When latch 1420 is in a released position 1425, the second frame 1405 and the stationary frame 1410 of the rollable chair can move independent of each other such that the seat frame 1415 of the rollable chair can translate and rotate, as shown in FIG. 13E-13F. The rearward pull that releases latch 1420 can also pull the seat frame 1415 and second frame 1405 of the rollable chair rearward. Referring back to FIG. 13E, when the seat slide frame 1330*b* and the seat rotation frame 1335*b* of the docking assembly station translate away from the rollable chair a first distance (e.g., 8.5 inches), the seat frame 1415 and the second frame 1405 of the rollable chair are pulled the first distance towards the bed 1304*a* along the first axis 1302*a*, while the stationary frame 1410 of the rollable chair remains stationary. While the seat frame 1415 and mechanical frame 1405 move the first distance, a shuttle 1430 of the rollable chair and the mechanical frame 1405 of the rollable chair can lock together with an interlock mechanism. The interlock mechanism can include an interlock pin 1435 trapped in grooves 1440 in both the shuttle 1430 and the mechanical frame 1405.

Once the seat frame 1415 and mechanical frame 1405 have translated the first distance, the interlock mechanism can drop the interlock pin 1435 from the shuttle groove 1440. The interlock pin 1435 can disengage from the shuttle 1430 by dropping into a groove 1440 in the stationary frame 1410, thus locking the mechanical frame 1405 to the stationary frame 1410 (e.g., wheel frame) while allowing the shuttle 1430 to freely translate within the mechanical frame 1405. At this point, the seat of the rollable chair can translate in a direction towards the bed 1304*a* along the first axis 1302*a*. Locking the mechanical frame 1405 and the stationary frame 1410 can ensure that the seat of the rollable chair does not translate or rotate away from the bed 1302*a* during patient transfer.

When the interlock pin 1435 is in a dropped position, the shuttle 1430 can translate within the mechanical frame 1405. The shuttle 1430 can be fixed to a point on cable 1445 of the rollable chair. When the seat rotation frame 1335*b* of the docking assembly translates away from the rollable chair a second distance (e.g., as shown in FIG. 13F), the seat frame hook 1355*c* of the rollable chair is pulled rearward, thus, pulling the shuttle 1430 rearward. Pulling the shuttle 1430 rearward can cause tension in the cable 1445. The tension in cable 1445 can be counteracted by a forward idler pulley 1450 of the 2 idler pulleys 1450, which in turn can activate driven pulley 1455 such that the driven pulley 1455 rotates in a counter-clockwise direction (on a right hand portion of the rollable chair when viewed from the right side). The driven pulley 1455 can rotate until the seat of the rollable chair rotates a desired angular amount (e.g., 110 degrees or 115 degrees).

As shown in FIGS. 13A-F above, upon sensing that a patient is being transferred into the rollable chair, the docking assembly can translate the seat rotation frame 1335*b* of the docking assembly towards the rollable chair a first distance (e.g., 9.0 inches). The seat frame hook 1355*c* of the rollable chair is pushed forward, thus, pushing the shuttle 1430 forward. Pushing the shuttle 1430 forward can cause tension in a rear portion of the cable 1445. The tension in cable 1445 can be counteracted by a rear idler pulley 1450 of the 2 idler pulleys 1450, which in turn can activate driven pulley 1455 such that the driven pulley 1455 rotates in a clockwise direction (on a right hand portion of the rollable chair when viewed from the right side). The driven pulley 1455 rotates until the rollable chair seat can rotate a desired angular amount (e.g., 110 degrees or 115 degrees).

Once the seat rotation frame 1335*b* of the docking assembly moves the entire first distance (e.g., 9.0 inches), as shown in FIG. 13F, the interlock mechanism can force the interlock pin 1435 to move into a groove 1440 in the shuttle 1430, thus locking the mechanical frame 1405 to the shuttle 1430 while allowing the mechanical frame 1405 to translate in relation to the wheel frame 1410.

Once the interlock pin 1435 is positioned such that the mechanical frame 1405 and the wheel frame 1410 are locked to move in unison, the seat slide frame 1330*b* and the seat rotation frame 1335*b* of the docking assembly translate away from the bed a second distance (e.g., 8.5 inches), as shown in FIG. 13E. Translating the seat slide frame 1330*b* and the seat rotation frame 1335*b* forward along the first axis 1302*a* can cause the mechanical frame 1405 and the third frame of the rollable chair to move forward, thus translating the seat of the rollable chair into a rollable chair mode position.

Once the seat slide frame 1330*b* and the seat rotation frame 1335*b* have moved the entire second distance (e.g., the seat of the rollable chair is in its forward most position) as shown in FIGS. 13B-D, the latch 1420 engages such that the mechanical frame 1405 is locked to the stationary frame 1410.

In various embodiments, multiple sensors are employed such that various events during patient transfer between the bed as described in FIG. 6 and the rollable chair as described in FIGS. 11-12 can be detected. For example, a sensor can sense that a patient's back is resting on the bed, such that the bed can begin to move from a back rest position to a horizontal position. Once in the horizontal position, a sensor can sense that the patient's back is on the bed so that the conveyor can begin to rotate.

When transferring a patient from the bed to the rollable chair, a sensor can sense that the patient has been placed in the rollable chair such that the seat of the rollable chair 1370*d* can begin to rotate to a rollable chair ride position, as shown in FIG. 1.

An embodiment of transferring a patient between a bed as shown in FIG. 6 and chair as shown in FIGS. 11-12, can involve moving the bed as shown in FIGS. 2-5(*b*). When the bed 110 is in a patient transfer position 400, the rollable chair can be translated toward the bed as shown in FIG. 1. The rollable chair can connect to the docking assembly as shown in FIGS. 13A-13F.

When returning to rollable chair mode (e.g., the patient is transferred from the bed into the rollable chair) the rotation and interlock system of the rollable chair can rotate the rollable chair seat back to a position parallel to the first axis 1302*a* and translate the seat forward in a direction away from the bed 1304*a*, such that the rollable chair can be used by a patient to ride.

It will be apparent to one of ordinary skill in the art that one or more controllers can control the bed, the docking assembly and/or the rollable chair.

Figure 15:
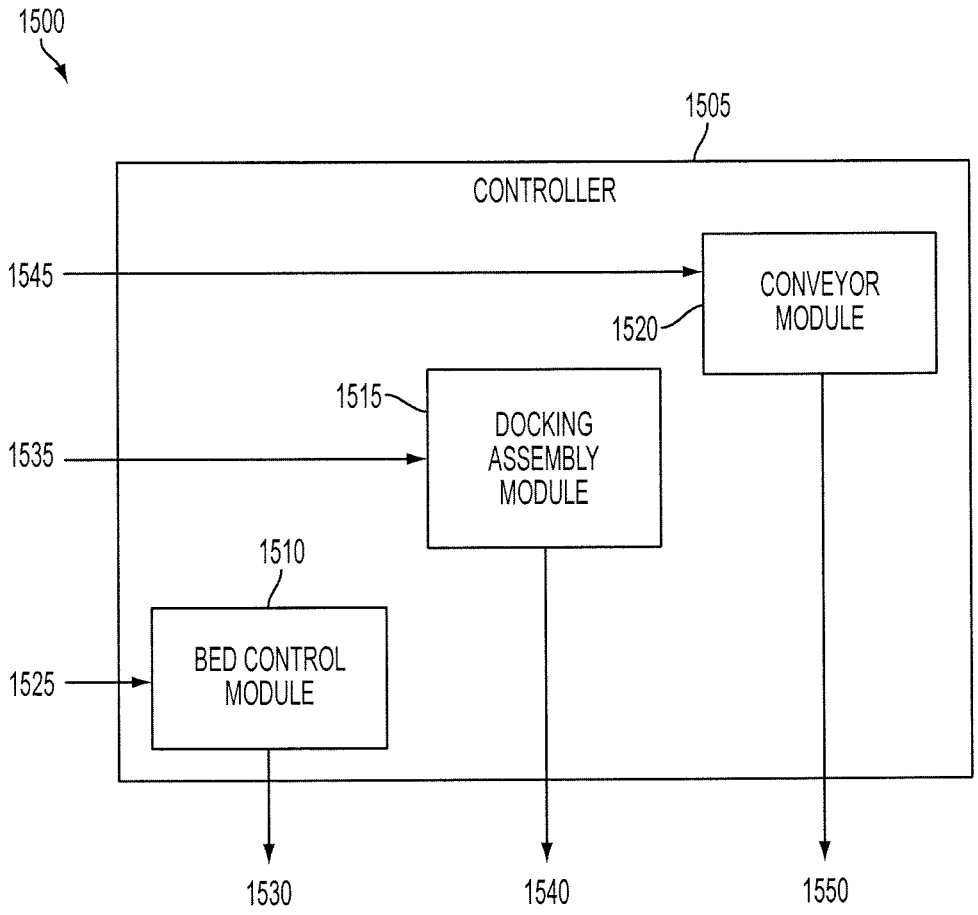
FIG. 15 is a diagram showing a controller, according to an illustrative embodiment of the invention.

FIG. 15 is a diagram 1500 showing a controller, according to an illustrative embodiment of the invention. FIG. 15 shows a controller 1505 for controlling a patient transfer assembly between a bed and a rollable chair. The controller 1505 includes a bed control module 1510, a docking assembly module 1515, and a conveyor module 1520.

The bed control module 1510 receives a first input 1525. The first input 1525 includes one or more bed position measurements from one or more sensors coupled to a bed, information regarding whether a patient is being transferred into the bed, or transferred into the chair, information regarding the position of the patient, information regarding the position of the docking assembly and the rollable chair, and/or values/commands input by a user.

The bed control module 1510 determines a value for each output of the first output, based, at least, on the first input 1525 and/or other preset values within the controller. For example, if the rollable chairs docks to a docking assembly, a caregiver inputs to the controller to transfer a patient from the rollable chair and the bed, and the bed is in a horizontal position, the bed control module 1510 determines a first output of a first angle and a second angle such that a head bed frame portion and a foot bed frame portion of the bed rotate to a position for patient transfer. The first output 1530 can include a first angle to rotate a head bed frame portion, a second angle to rotate a foot bed frame portion, or raise or lower the bed frame to a desired height.

The bed control module outputs 1530 each value to the bed.

The docking assembly module 1515 receives a second input 1535. The second input 1535 includes one or more bed and/or chair position measurements from one or more sensors coupled to the bed, the chair, and/or a docking assembly, information regarding whether a patient is being transferred into the bed, or transferred into the chair, information regarding the position of the patient, information regarding the position of the docking assembly and the rollable chair, and/or values/commands input by a user.

The docking assembly module 1515 determines a value for each output of the second output, based, at least, on the second input 1535. The second input includes one or more bed, chair, docking position measurements, and/or other preset values within the controller. For example, if the rollable chairs docks to a docking assembly, a caregiver inputs to the controller to transfer a patient from the rollable chair and the bed, the docking assembly module 1515 determines a distance and angle such that a seat of the chair translates and rotates for patient transfer.

The docking assembly module outputs 1540 each value to the docking assembly.

The conveyor module receives a third input 1545. The third input includes one or more bed position measurements from one or more sensors coupled to a bed, information regarding whether a patient is being transferred into the bed, or transferred into the chair, information regarding the position of the patient, information regarding the position of the docking assembly and the rollable chair, and/or values/commands input by a user.

The conveyor module determines a value for each output of the third output, based, at least, on the third input 1545. The third input includes one or more bed, chair, and/or other preset values within the controller. For example, if the rollable chairs docks to a docking assembly, a caregiver inputs to the controller to transfer a patient from the rollable chair and the bed, the conveyor module determines a position of a conveyor on the bed for patient transfer.

The conveyor module outputs 1550 each value to the bed.

Figure 16B:
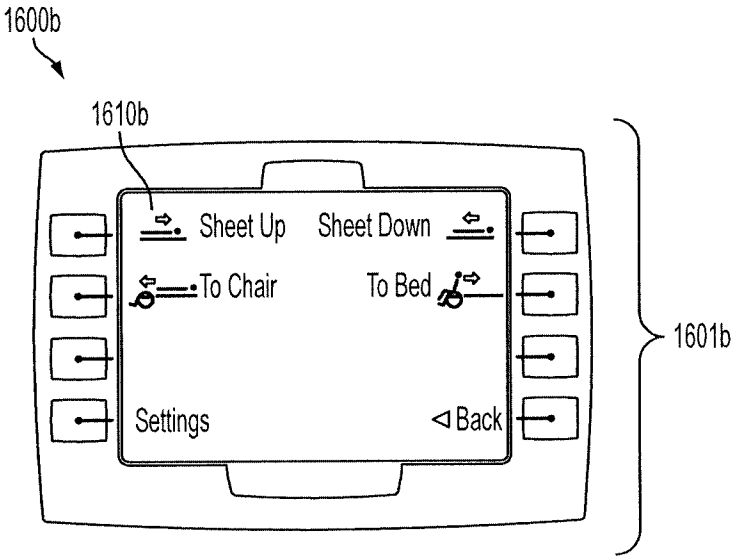
FIG. 16A-16B are diagrams showing perspective views of an interface of a controller, according to an illustrative embodiment of the invention.
Figure 16A:
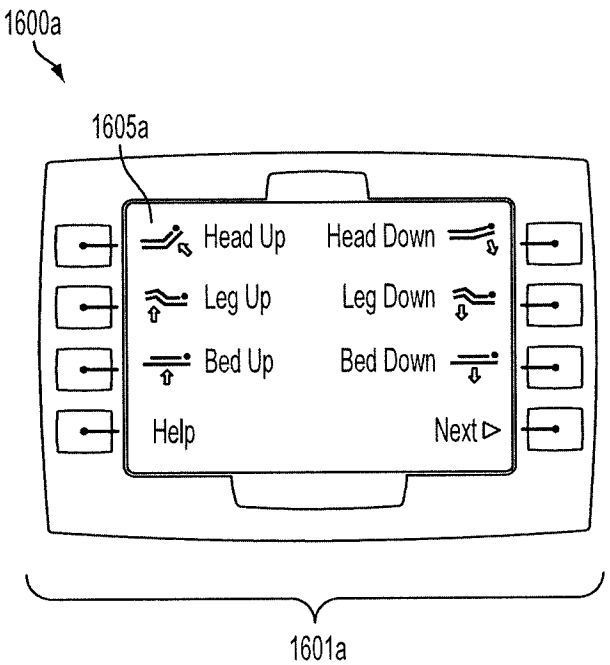

FIGS. 16A-16B are diagrams 1600*a*, 1600*b* showing of an interface of a controller, according to an illustrative embodiment of the invention. Interfaces 1601*a*, 1601*b* can be used to control a transfer bed, a rollable chair, and a docking assembly. For example, when a user depress a "Head Up" button 1605*a*, the interface transmits a command to the controller to rotate the head frame portion of the bed (e.g., as described above in FIG. 6). For example, when a user depresses a "Sheet Up" button 1610*b*, the interface transmits a command to the first spool and the second spool to rotate so the conveyor translates towards the head end of the bed (e.g., as described above in FIG. 6).

The interface can include the controller or the controller can be a separate entity from the interface.

In various embodiments, the disclosed methods can be implemented as a computer program product for use with a computer system. Such implementations can include a series of computer instructions fixed either on a tangible medium, such as a computer readable medium (e.g., a diskette, CD-ROM, ROM, or fixed disk) or transmittable to a computer system, via a modem or other interface device, such as a communications adapter connected to a network over a medium. The medium can be either a tangible medium (e.g., optical or analog communications lines) or a medium implemented with wireless techniques (e.g., microwave, infrared or other transmission techniques). The series of computer instructions embodies all or part of the functionality previously described herein with respect to the system. Those skilled in the art should appreciate that such computer instructions can be written in a number of programming languages for use with many computer architectures or operating systems.

Furthermore, such instructions can be stored in any memory device, such as semiconductor, magnetic, optical or other memory devices, and can be transmitted using any communications invention, such as optical, infrared, microwave, or other transmission technologies. It is expected that such a computer program product can be distributed as a removable medium with accompanying printed or electronic documentation (e.g., shrink wrapped software), preloaded with a computer system (e.g., on system ROM or fixed disk), or distributed from a server or electronic bulletin board over the network (e.g., the Internet or World Wide Web). Of course, some embodiments of the invention can be implemented as a combination of both software (e.g., a computer program product) and hardware. Still other embodiments of the invention are implemented as entirely hardware, or entirely software (e.g., a computer program product).

The described embodiments of the invention are intended to be merely exemplary and numerous variations and modifications will be apparent to those skilled in the art. All such variations and modifications are intended to be within the scope of the present invention as defined in any appended claims.

What is claimed is:

1. A docking assembly, comprising:

a first frame attachable to a chair and, after attachment, stabilizing the chair to keep the chair substantially stationary when a patient is transferred into and out of the chair, a first latch coupled to the first frame to detachably attach the first frame to the chair;

a second frame mounted on the first frame and capable of translating relative to the first frame along a first axis, the second frame attachable to the chair and causing the seat of the chair to translate, a second latch coupled to the second frame to detachably attach the second frame to the chair; and a third frame mounted on the second frame and capable of translating relative to the second frame along the first axis, the third frame attachable to the chair and causing the seat of the chair to rotate, a third latch coupled to the third frame to detachably attach the third frame to the chair.

2. The docking assembly of claim 1, wherein the first frame detachably attaches to a first frame of the chair.

3. The docking assembly of claim 1, wherein the second frame mounts to the first frame to by one or more sliding assemblies.

4. The docking assembly of claim 1, wherein the third frame mounts to the second frame by one or more sliding assemblies.

5. The docking assembly of claim 1 further comprising one or more actuators to translate the second frame a first desired distance and a first desired direction relative to the first frame, translate the third frame a second desired distance and a second desired direction relative to the second frame, or any combination thereof.

6. The docking assembly of claim 1 further comprising a housing that surrounds the first frame, the second frame and the third frame.

7. The docking assembly of claim 1 wherein the docking assembly detachably attaches to an apparatus to be stabilized.

8. The docking assembly of claim 1 wherein the docking assembly detachably attaches to a wheelchair or a walker.

9. The docking assembly of claim 1 wherein the docking assembly detachably attaches to a bed.

10. A method for attaching a chair to a docking assembly, comprising:

attaching a chair to a first frame and, after attachment, stabilizing the chair to keep the chair substantially stationary when a patient is transferred into and out of the chair;

coupling a first latch to the first frame to detachably attach the first frame to the chair;

attaching the chair to a second frame mounted on the first frame and capable of translating relative to the first frame along a first axis, the second frame attachable to the chair and causing the seat of the chair to translate;

coupling a second latch to the second frame to detachably attach the second frame to the chair;

attaching the chair to a third frame of the docking assembly, the third frame mounted on the second frame and capable of translating relative to the second frame along the first axis, the third frame attachable to the chair and causing the seat of the chair to rotate; and coupling a third latch to the third frame to detachably attach the third frame to the chair.

11. The method of claim 10 further comprising configuring one or more actuators to translate the second frame a first desired distance and a first desired direction relative to the first frame, translate the third frame a second desired distance and a second desired direction relative to the second frame, or any combination thereof.

12. The method of claim 10 further comprising attaching the docking assembly to a bed.

13. The method of claim 10 wherein the chair is a wheelchair.

* * * * *